US008202491B2

(12) United States Patent
Masters et al.

(10) Patent No.: US 8,202,491 B2
(45) Date of Patent: Jun. 19, 2012

(54) APPARATUS FOR ANALYTE PROCESSING

(75) Inventors: Brett Masters, Watertown, MA (US); Eric France, Quincy, MA (US); Peter Wight Falb, Hingham, MA (US); Matthew Kavalauskas, Littleton, MA (US); David Brancazio, Cambridge, MA (US)

(73) Assignee: BioScale, Inc., Lexington, MA (US)

( * ) Notice: Subject to any disclaimer, the term of this patent is extended or adjusted under 35 U.S.C. 154(b) by 774 days.

(21) Appl. No.: 11/603,347

(22) Filed: Nov. 21, 2006

(65) Prior Publication Data

US 2008/0115599 A1 May 22, 2008

(51) Int. Cl.
*B01L 99/00* (2010.01)
*B01L 3/00* (2006.01)

(52) U.S. Cl. ..... 422/503; 422/500; 422/501; 422/502; 422/504; 422/554

(58) Field of Classification Search ..... 422/100; 73/61.43, 866
See application file for complete search history.

(56) References Cited

U.S. PATENT DOCUMENTS

| | | | | |
|---|---|---|---|---|
| 5,023,053 | A | 6/1991 | Finlan | 422/82.05 |
| 5,199,298 | A | 4/1993 | Ng et al. | 73/54.01 |
| 5,200,084 | A | 4/1993 | Liberti et al. | 210/695 |
| 5,313,264 | A * | 5/1994 | Ivarsson et al. | 356/73 |
| 5,376,252 | A | 12/1994 | Ekström et al. | 204/299 |
| 5,443,890 | A | 8/1995 | Öhman | 428/167 |
| 5,454,904 | A | 10/1995 | Ghezzo et al. | 216/13 |
| 5,458,852 | A | 10/1995 | Buechler | 422/58 |
| 5,593,130 | A | 1/1997 | Hansson et al. | 251/61.1 |
| 5,744,367 | A | 4/1998 | Talley et al. | 436/172 |
| 5,836,203 | A | 11/1998 | Martin et al. | 73/579 |
| 5,885,527 | A | 3/1999 | Buechler | 422/58 |
| 6,008,893 | A | 12/1999 | Roos et al. | 356/246 |
| 6,019,944 | A | 2/2000 | Buechler | 422/58 |
| 6,113,855 | A | 9/2000 | Buechler | 422/58 |
| 6,133,043 | A | 10/2000 | Talley et al. | 436/172 |
| 6,143,576 | A | 11/2000 | Buechler | 436/518 |
| 6,156,270 | A | 12/2000 | Buechler | 422/58 |
| 6,271,040 | B1 | 8/2001 | Buechler | 436/170 |
| 6,429,025 | B1 | 8/2002 | Parce et al. | 436/514 |
| 6,448,944 | B2 | 9/2002 | Ronzani et al. | 345/8 |
| 6,454,924 | B2 * | 9/2002 | Jedrzejewski et al. | 204/601 |

(Continued)

FOREIGN PATENT DOCUMENTS

EP 1752663 2/2007

(Continued)

OTHER PUBLICATIONS

S. Sjölander et al., "Integrated Fluid Handling System for Biomolecular Interaction Analysis," Anal. chem., vol. 63 (1991), pp. 2338-2345.

(Continued)

*Primary Examiner* — Jill Warden
*Assistant Examiner* — Dean Kwak
(74) *Attorney, Agent, or Firm* — Proskauer Rose LLP

(57) ABSTRACT

The invention relates to a cartridge for processing a sample and methods for aligning a cartridge. The cartridge includes a processing device for processing a sample, a body having a surface and bounded by at least one edge, and a plurality of positioning members defined by the surface for aligning the processing device relative to a conduit defined by the body between a cartridge input and a cartridge output.

13 Claims, 23 Drawing Sheets

U.S. PATENT DOCUMENTS

| | | | | |
|---|---|---|---|---|
| 6,457,361 | B1 | 10/2002 | Takeuchi et al. | 73/580 |
| 6,558,944 | B1 | 5/2003 | Parce et al. | 435/287.2 |
| 6,669,907 | B1 | 12/2003 | Buechler | 422/58 |
| 6,688,158 | B2 | 2/2004 | Cunningham et al. | 73/24.06 |
| 6,698,454 | B2 | 3/2004 | Sjölander et al. | 137/885 |
| 6,720,710 | B1 | 4/2004 | Wenzel et al. | 310/328 |
| 6,767,510 | B1 | 7/2004 | Buechler | 422/58 |
| 6,790,775 | B2 | 9/2004 | Fartash | 438/667 |
| 7,118,922 | B1 | 10/2006 | Bhansali et al. | 436/518 |
| 7,410,811 | B2 | 8/2008 | Lin et al. | 436/526 |
| 2002/0086436 | A1 | 7/2002 | Buechler | 436/164 |
| 2002/0128593 | A1 | 9/2002 | Sjolander et al. | 604/22 |
| 2003/0022388 | A1 | 1/2003 | Roos et al. | 436/164 |
| 2003/0134431 | A1 | 7/2003 | Parce et al. | 436/518 |
| 2003/0154031 | A1 | 8/2003 | Potyrailo et al. | 702/19 |
| 2005/0040907 | A1 | 2/2005 | Nebrigic | 332/118 |
| 2005/0214173 | A1* | 9/2005 | Facer et al. | 422/100 |
| 2006/0257945 | A1 | 11/2006 | Masters et al. | |
| 2006/0286685 | A1* | 12/2006 | Miller et al. | 436/526 |
| 2007/0037142 | A1 | 2/2007 | Sauer-Budge et al. | |
| 2007/0037231 | A1 | 2/2007 | Sauer-Budge et al. | |
| 2007/0042441 | A1 | 2/2007 | Masters et al. | |
| 2007/0059212 | A1 | 3/2007 | Masters et al. | |

FOREIGN PATENT DOCUMENTS

| | | |
|---|---|---|
| WO | WO 2005/111426 | 11/2005 |
| WO | 2006/119308 | 11/2006 |
| WO | 2007/030155 | 5/2007 |

OTHER PUBLICATIONS

R. C. Anderson et al., "Genetic Analysis Systems: Improvements and Methods," Solid-State Sensor and Actuator Workshop, Hilton Head Island, South Carolina, Jun. 8-11, 1998, pp. 7-10.

C. Bisson et al., "A Microanalytical Device for the Assessment of Coagulation Parameters in Whole Blood," Solid-State Sensor and Actuator Workshop, Hilton Head Island, South Carolina, Jun. 8-11, 1998, pp. 1-6.

J. M. Dodson et al., "Fluidics Cube for Biosensor Miniaturization," Analytical Chemistry, vol. 73, No. 15, Aug. 1, 2001, pp. 3776-3780.

P. Galambos et al., "Precision Alignment Packaging for Microsystems with Multiple Fluid Connections," Proceeding of 2001 ASME: International Mechanical Engineering Conference and Exposition, Nov. 11-16, 2001, New York, NY, pp. 1-8.

E. F. Hasselbrink, Jr., et al., "High-Pressure Microfluidic Control in Lab-on-a-Chip Devices Using Mobile Polymer Monoliths," Analytical Chemistry, vol. 74, No. 19, Oct. 1, 2002, pp. 4913-4918.

C. R. Tamanaha et al., "Hybrid macro-micro fluidics system for a chip-based biosensor," Journal of Micromechanics and Microengineering, vol. 12, 2002, pp. N7-N17.

D. Trebotich et al., "Complex Fluid Dynamics in BioMEMS Devices: Modeling of Microfabricated Microneedles," Modeling and Simulation of Microsystems, (2002), pp. 10-13.

V. Linder et al., "Reagent-Loaded Cartridges for Valveless and Automated Fluid Delivery in Microfluidic Devices," Analytical Chemistry, vol. 77, No. 1, Jan. 1, 2005, pp. 64-71.

D. Armani et al., "Re-Configurable Fluid Circuits by PDMS Elastomer Micromachining," Proc. of the IEEE Micro Electro Mechanical Systems, Orlando, FL, Jan. 1999, pp. 222-227.

K. S. Breuer, "Design, Fabrication and Performance of MEMS Actuators for Flow Control," in Flow Control and MEMs, Von Karman Institute Lecture Series, Rhode Saint Genese, Belgium, 2002.

K. V. Sharp et al., "Liquid Flows in Microchannels," Ch. 6, The MEMS Handbook, CRC Press, New York, 2002, pp. 6-1-6-38.

J. Molho et al., "Fluid Transport Mechanisms in Microfluidic Devices," Proc. ASME Micro-Electro-Mechanical-Systems (MEMS), 1998.

P. M. St. John et al., "Metrology and Simulation of Chemical Transport in Microchannels," Solid-State Sensors and Actuators Workshop, Hilton Head, SC, 1998.

Applied Biosytems—Products and Services, at "http://www.appliedbiosystems.com/catalog/" (last visited May 24, 2005), pp. 1-2.

Applied Biosystems Catalog, at "http://www.appliedbiosystems.com/catalog/myab/Storecatalog/products/CatalogDrillDown.jsp?hierarchyID=101&category1st=..." (last visited May 24, 2005), pp. 1-2.

Applied Biosystems Catalog, at "http://www.appliedbiosystems.com/catalog/myab/Storecatalog/products/CatalogDrillDown.jsp?hierarchyID=101&category1st=..." (last visited May 24, 2005), p. 1.

Grate, et al., "Acoustic Wave Sensors," Sensors Update, 1996, pp. 37-83.

Offer Letter for Sale of the BioScale B300 Instrument System Sent to a Customer on Sep. 9, 2004 (1 pg.).

* cited by examiner

FIG. 4J
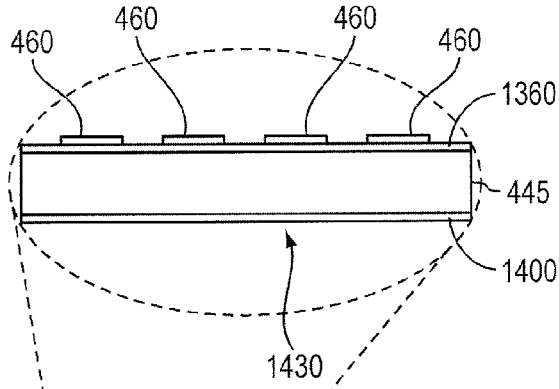
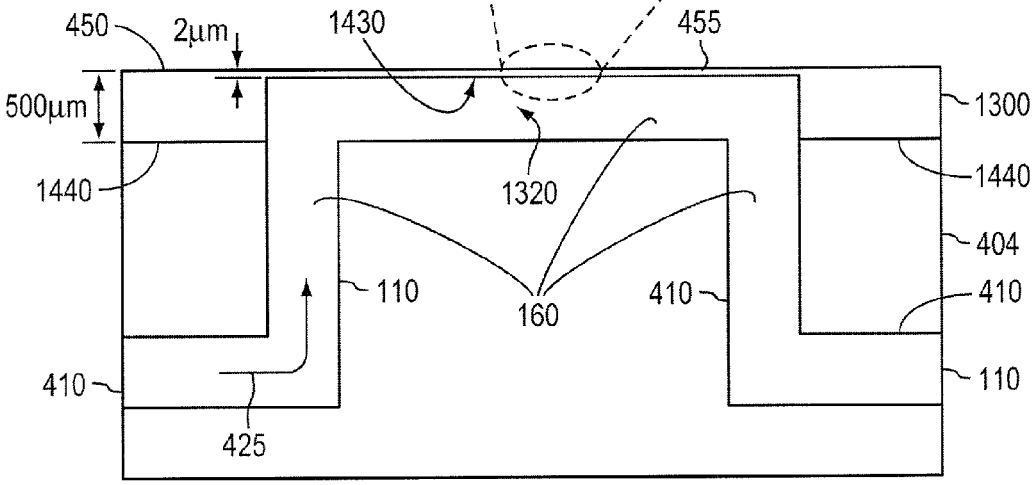
FIG. 4I

APPARATUS FOR ANALYTE PROCESSING

TECHNICAL FIELD

The present invention relates to systems for processing an analyte.

BACKGROUND OF THE INVENTION

Conventional systems that detect analytes have limited flexibility and are unable to accurately and repeatably analyze a variety of analytes in a range of volumes and under a range of flow rates. Some inflexible analyte detection systems enable sample addition at only a single point in time and/or location in the analysis process. Thus, conventional analyte detection systems are limited to use in certain applications. Further, systems that detect analytes (e.g., biological agents) are generally large in size, precluding system use in certain applications, for example, in the field. In addition, systems that detect analytes are limited, because analyte sample contamination requires the entire system to be sterilized by, for example, autoclaving after each detection cycle.

SUMMARY OF THE INVENTION

Systems of the invention address challenges to systems for processing an analyte. The system enables consistent conditions at the point when the analyte (i.e., a sample) is exposed to the processing device (e.g., a sensor such as a flexural plate wave device). The system can be employed in a large range of volumetric flow rates (e.g., a flow rate within the range of from about 3 microliters/minute to about 1,000 microliters/minute or from about 6 microliters/minute to about 500 microliters/minute per channel). The system can be used to process a variety of analytes such as, for example, body fluid samples containing communicable diseases such as, for example, HIV and other pathogens. For example, one or more portions of the system can be disposable, which enables the system to be cleaned such that contamination risk is removed between different samples. A first analyte sample is prevented from contaminating a second analyte sample, for example. In some embodiments, sterilizing the system between each detection cycle (by, for example, autoclaving) is avoided.

During the analysis of a given sample by the system, e.g., sample "A", processing of the sample "A" is repeatable such that the analyte sample is consistently transported to a surface of the processing device (e.g., a sensor surface). The number of streams of the samples and/or types of samples that are transported through the system is flexible. In addition, the different parts of the analysis system are preferably sized to enable portability for use in the field. The system prevents disruption of the processor during sample processing. The compact system repeatably makes fluid, mechanical, and electrical contact enabling consistent and reliable analyte analysis and/or processing. In one embodiment, the analyte sample volumetric flow rate is maintained substantially consistent throughout the analysis. In another embodiment, the analyte sample volumetric flow rate varies throughout the analysis.

In one aspect, the invention relates to a system for processing a sample. The system includes a fluid reservoir, a plurality of sample reservoirs, a plurality of channels, and a pump. The pump has an input side and an output side. A segment of each of the plurality of channels is disposed between the input side and the output side, the pump synchronously draws from the fluid reservoir and the plurality of sample reservoirs to provide a plurality of samples through the plurality of channels.

A flexural plate wave device processes the plurality of samples in the plurality of channels. In one embodiment, the plurality of channels contact the flexural plate wave device. The flexural plate wave device contacts, for example, the plurality of samples being drawn through the plurality of channels. The system can include a fluid output for disposal of the sample.

In one embodiment, the pump rotates about an axis substantially perpendicular to the segment. The pump can have a plurality of rollers that rotate about the axis substantially perpendicular to the segment of each of the plurality of channels and the plurality of rollers rotate when the pump rotates.

In another embodiment, the input side has a plurality of pump input grooves, the output side has a plurality of pump output grooves, and the segment of one of the plurality of channels is disposed between a first pump input groove and a first pump output groove. The first pump input groove and the first pump output groove tension fit the segment of one of the plurality of channels over a surface of the pump. In still another embodiment, the input side has a plurality of pump input grooves, the output side has a plurality of pump output grooves, and the segment of each of the plurality of channels is disposed between the plurality of pump input grooves and the plurality of pump output grooves. The plurality of pump input grooves and the plurality of pump output grooves tension fit the segment of each of the plurality of channels over a surface of the pump.

The segment of each of the plurality of channels can be disposed between a cover and the pump, optionally, the pump is disposed in a housing and the cover is fastened to the housing. In one embodiment, the pump is disposed in a housing and a portion of the pump is exposed above a surface of the housing.

The system can include a tubing grip that interlocks with a housing and, for example, the pump is disposed in the housing. The tubing grip can have a plurality of pump grooves and a portion of each of the plurality of channels is disposed in a pump groove. The segment of each of the plurality of channels can be a segment of a flexible tube that is disposed between the input side and the output side.

Each of the plurality of channels can have a volumetric flow rate within the range of from about 1 microliters/minute to about 1,000 microliters/minute or from about 6 microliters/minute to about 500 microliters/minute. In one embodiment, each of the plurality of samples has a synchronized flow rate. In another embodiment, the input side of the segment of each of the plurality of channels is less than about 3.3 inches from the flexural plate wave device. The input side of the segment of each of the plurality of channels is, for example, disposed in the pump cover and the input side is less than about 3.3 inches from the flexural plate wave device.

In another aspect, the invention relates to a valve for a sample processing system. The valve includes an enclosure having a first side and a second side adjacent to and substantially parallel to the first side. A first end is disposed between and is substantially perpendicular to the first side and the second side. A second end is disposed between and is substantially perpendicular to the first side and the second side. The first side has a plurality of valve input grooves and the second side has a plurality of valve output grooves. A segment of a tube is disposed between a first valve input groove and a first valve output groove. A pin is disposed beneath a dowel within the enclosure. The first end of the dowel fastens to the first end of the enclosure and the second end of the dowel fastens to the second end of the enclosure. A pusher pushes the pin toward a fastened dowel.

In one embodiment, a segment of a tube is pinched between the pin and the fastened dowel. The tube is, for example, a portion of a channel. In one embodiment, a portion of the tube is disposed in the first valve input groove and another portion of the tube is disposed in the first valve output groove. Optionally, a second valve input groove is disposed adjacent the first valve input groove and a second valve output groove is disposed adjacent the first valve output groove. In one embodiment, a portion of the second tube is disposed in the second valve input groove and another portion of the second tube is disposed in the second valve output groove.

In another aspect, the invention relates to a system for processing a sample. The system includes a fluid reservoir and a sample reservoir. A channel draws from the fluid reservoir and the sample reservoir to provide a sample. A valve includes an enclosure. The enclosure has a first side and a second side adjacent to and substantially parallel to the first side, a first end is disposed between and substantially perpendicular to the first side and the second side, and a second end is disposed between and substantially perpendicular to the first side and the second side. The first side has a plurality of valve input grooves and the second side has a plurality of valve output grooves. A portion of the channel is disposed in the first valve input groove and another portion of the channel is disposed in the first valve output groove. A pin is disposed beneath a dowel within the enclosure. The dowel has a first end fastened to the first end of the enclosure and a second end fastened to the second end of the enclosure. A pusher pushes the pin toward a fastened dowel. A processing device processes the sample in the channel.

In one embodiment, the system has a pump having an input side and an output side. A segment of the channel is disposed between the input side and the output side. The pump rotates about an axis substantially perpendicular to the segment of the channel and the pump for pulls the sample through the channel. Optionally, the segment of the channel is disposed between a cover and the pump. The system can also have a fluid output for disposal of the sample.

In another aspect, the invention relates to a system for processing a sample. The system has a fluid reservoir and a plurality of sample reservoirs. A plurality of channels draw from the fluid reservoir and the plurality of sample reservoirs to provide a sample. A processing device processes the sample. The processing device has a plurality of electrical contact pads. A segment of the plurality of channels, and the processing device are disposed on a top surface of a supporting surface, for example, a plate. The plate can have registration features such as positioning pins or positioning apertures to position the processing device. The plate can be disposed on a supporting surface, for example, the housing. A socket has a plurality of magnets and a plurality of electrical contact points are disposed about a surface of the socket. The electrical contact points are complementary to the plurality of contact pads on the processing device. The socket is disposed in a position substantially parallel to the top surface of the supporting surface (e.g., the plate and/or the housing) and the socket moves in a substantially vertical direction toward the processing device. The plurality of electrical contact points contact the complementary plurality of electrical contact pads. The plurality of magnets actuate to align with the processing device. The plurality of magnets are centered substantially over the sensor surface of the processing device.

In one embodiment, alignment of the plurality of magnets with the processing device is ensured when registration features on the socket (e.g., positioning pins) engage with registration features on the supporting surface (e.g., positioning apertures). The plurality of magnets are, for example, disposed on the socket.

In one embodiment, the system also has a fluid output for disposal of the sample. In another embodiment, the system also has a cartridge for processing the sample. The processing device can be disposed on the cartridge, for example, on a top surface of the cartridge. Optionally, the cartridge has a plurality of positioning members and the cover has a plurality of complementary positioning members that mate with the plurality of positioning members thereby aligning the socket with the processing device. In one embodiment, a pneumatic or electromechanical device actuates the plurality of magnets to align with a processing device disposed on the cartridge. In one embodiment, each of the plurality of channels align with one of the plurality of magnets.

The system can include a cover enclosing a frame. The frame has a first foot and an adjacent second foot. A first end is substantially perpendicular to the first foot and a second end is substantially parallel to and is spaced from the first end. The first end has a rotation axis and the second end has a locking member. The socket is disposed in the frame and the cover rotates about the rotation axis. The first foot and the second foot contact the top surface. The locking member releasably secures the socket in a position substantially parallel to the top surface of the housing.

In another aspect, the invention relates to a method of actuating a processing device. The method includes rotating a socket into a position substantially parallel to a top surface of a housing. The socket is moved in a substantially vertical direction toward a processing device disposed on a supporting surface, for example, the top surface of the housing. A plurality of electrical contact pads disposed on the processing device are contacted with a plurality of electrical contact points disposed on a surface of the socket. A plurality of magnets disposed relative to the socket are actuated to align with the processing device. The method can optionally include aligning a positioning member defined by a cartridge with a complementary positioning member defined by the socket. The method can also include aligning the plurality of magnets with a plurality of channels defined by a cartridge.

In another embodiment, the invention provides a system for processing a sample that includes, a fluid reservoir, a plurality of sample reservoirs, a plurality of channels that draw from the fluid reservoir and the plurality of sample reservoirs to provide a sample. The system also includes a processing device for processing the sample and a thermal conditioning interface that contacts at least a portion of the plurality of channels to control the temperature of the sample. In one embodiment, the thermal conditioning interface controls the temperature of the sample as the sample is drawn through the plurality of channels and processed by the processing device. In another embodiment, the thermal conditioning interface controls the temperature of the sample as the sample is processed by the processing device. The processing device can be, for example, a flexural plate wave device. The temperature of the sample can control one or more of viscosity, density, and speed of sound of the sample processed by the processing device.

In one aspect, the invention relates to a cartridge for processing a sample. The cartridge includes a processing device for processing a sample and a body. The body has a surface and is bounded by at least one edge. A plurality of positioning members are defined by the surface. The plurality of positioning members are for aligning the processing device relative to a conduit defined by the body between a cartridge input and a cartridge output.

The cartridge can have a sample input disposed relative to the conduit. For example, a sample reservoir can be disposed on the body with a sample input at an end of the sample reservoir with the sample input disposed relative to the conduit. The cartridge input and the sample input can both be disposed on a top surface of the body. Optionally, the cartridge input and the sample input are the same input.

In one embodiment, the plurality of positioning members are apertures defined by the surface of the body. In another embodiment, the plurality of positioning members are pins disposed on the surface of the body. In another embodiment, one or more of the plurality of positioning members align the body with one or more of a plurality of complementary positioning members disposed relative to a plate. In still another embodiment, one or more of the plurality of positioning members align the body with one or more of a plurality of complementary positioning members disposed relative to a socket.

The processing device can be a sensor for sensing a sample in the conduit. The sample can be, for example, a blood sample taken from a patient. The processing device can be, for example, a flexural plate wave device and/or a silicon containing chip. A electrode cover can act as a cap that seals a surface of the processing device. The processing device can have a plurality of electrical contact pads. In one embodiment, one or more of the plurality of positioning members is adjacent the processing device. In one embodiment, the processing device processes a plurality of samples. The processing device processes the plurality of samples simultaneously or sequentially, for example.

In another embodiment, a second conduit is defined between a second cartridge input and a second cartridge output. The conduit and the second conduit can be sized to provide at least substantially the same length and/or at least substantially the same flow velocity. At least a portion of a conduit is, for example, adjacent the processing device. The conduit can include a discontinuity with, for example, the processing device adjacent the discontinuity. In one embodiment, a first portion of the conduit is upstream of the discontinuity and a second portion of the conduit downstream of the discontinuity and each portion (e.g., upstream and downstream) is sized to be smaller than the remaining portions of the conduit.

In one embodiment, the cartridge has a plurality of conduits defined between a plurality of cartridge inputs and a plurality of cartridge outputs. The conduit and the plurality of conduits are each sized to provide at least substantially the same length and/or at least substantially the same flow velocity.

A thermal transfer layer can be disposed on a portion of the surface. The thermal transfer layer can be a thin layer that allows for the transfer of thermal energy such that when the thermal transfer layer is in contact with a thermally controlled surface the thermal conditions of the thermally controlled surface condition a sample in a conduit. In this way, a sample within a conduit can be thermally conditioned prior to and/or after being processed by the processing device. Alternatively, or in addition, the thermal transfer layer can be hydrophilic layer. In one embodiment, the thermal transfer layer functions as a sealing layer.

In another aspect, the invention relates to a method for aligning a cartridge that includes providing a processing device disposed on a body, the body having a surface and being bounded by at least one edge. The surface defines a plurality of positioning members for aligning the processing device relative to a conduit. The conduit is defined by the body between a cartridge input and a cartridge output. One or more of the plurality of positioning members is placed in contact with a plurality of complementary positioning members defined by a plate. The method for aligning also includes placing one or more of the plurality of positioning members in contact with a plurality of complementary positioning members defined by a surface of a socket.

BRIEF DESCRIPTION OF THE DRAWINGS

The foregoing and other objects, feature and advantages of the invention, as well as the invention itself, will be more fully understood from the following illustrative description, when read together with the accompanying drawings which are not necessarily to scale.

FIG. 4I is a view of a Flexural Plate Wave (FPW) device.

FIG. 4J is a view of the sensor surface of the Flexural Plate Wave (FPW) device of FIG. 4I.

DETAILED DESCRIPTION OF THE INVENTION

Figure 1:
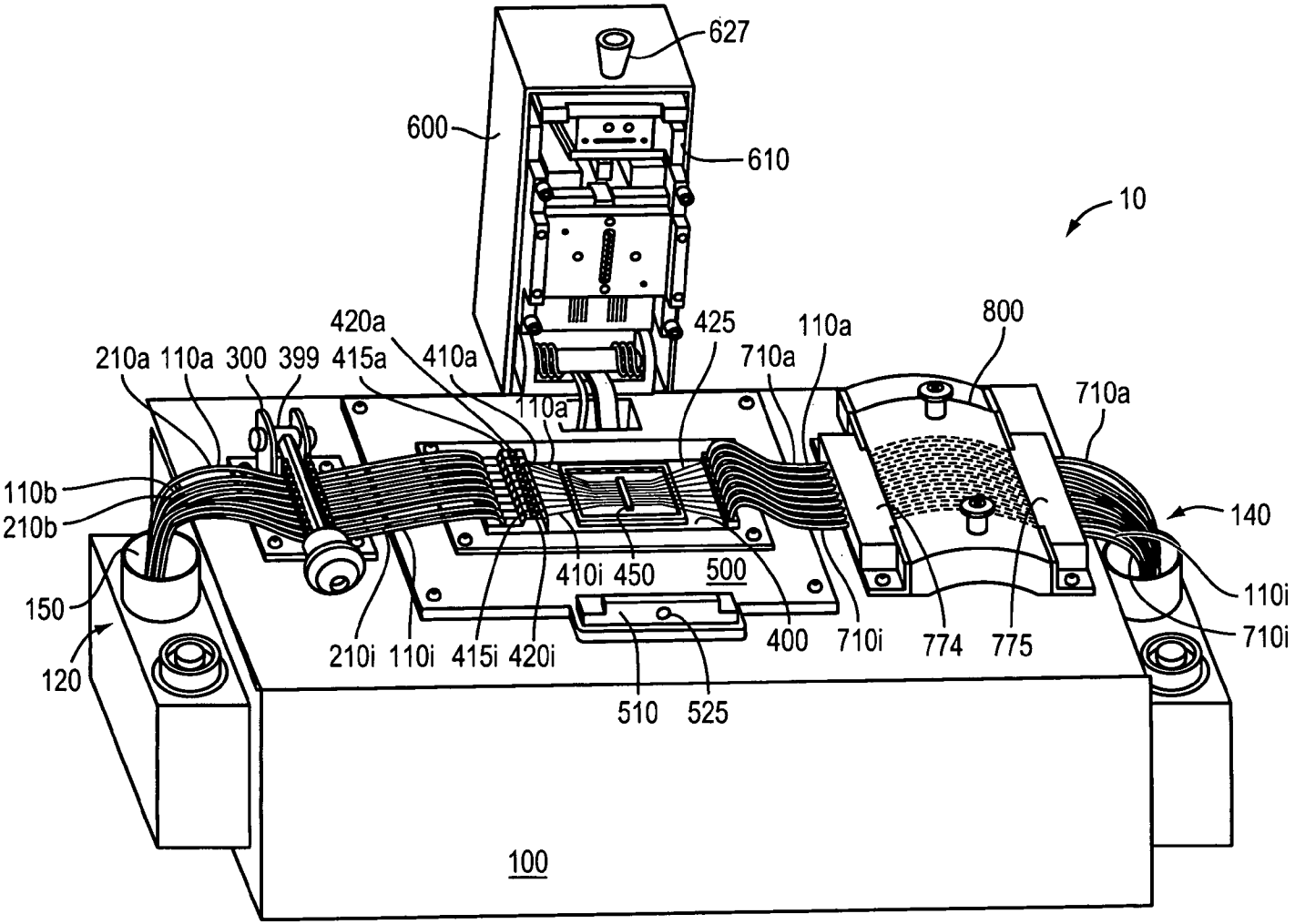
FIG. 1 is a top view of a system for processing an analyte sample.
Figure 2:
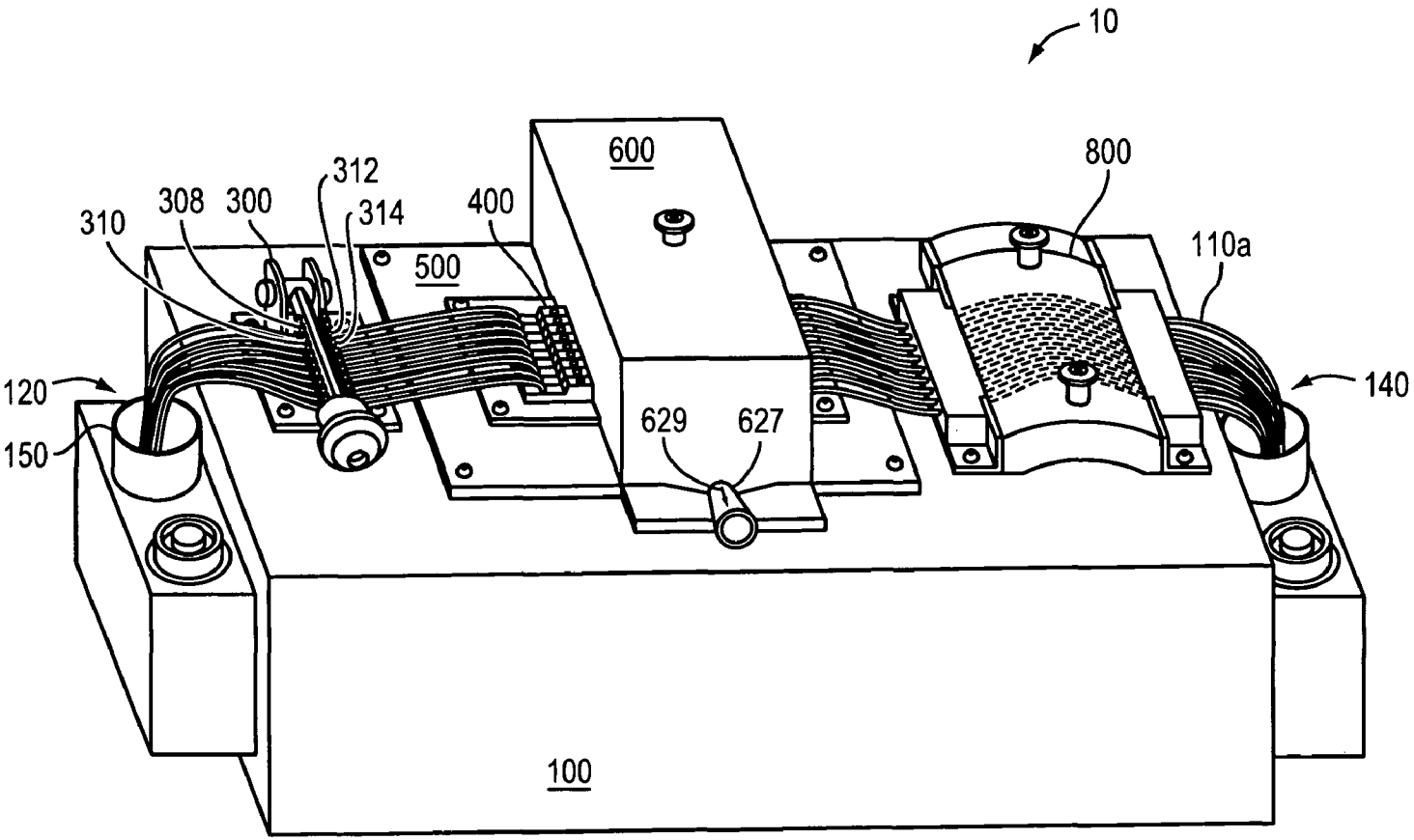
FIG. 2 is a top view of a system for processing an analyte sample with the cover in the closed position.

The invention relates to a compact system that repeatably makes fluid, mechanical, and electrical contact enabling reliable sample analysis. FIGS. 1 and 2 depict a system 10 for processing a sample, according to an illustrative embodiment of the invention. The system 10 includes a fluid input 120, a fluid output 140, and one or more channels 110*a*-110*i* (generally, 110) that transport fluid 150 from the fluid input 120 toward the fluid output 140. The channels 110 pull fluid 150 from the fluid input 120 toward the fluid output 140. In one embodiment, the system 10 includes a housing 100 and on one side of the housing 100 is the fluid input 120 and on the other side of the housing 100 is the fluid output 140. Fluid 150 is transported over the top surface of the housing 100 through the one or more channels 110*a*-110*i*.

A portion of each channel 110 is a tube 210. In one embodiment, each channel 110 includes one or more input tubes 210. In this embodiment, there are nine input tubes 210*a*-210*i* that pull fluid 150 from the fluid input 120 through each input tube 210*a*-210*i*. The fluid from each input tube 210 enters a cartridge input 401 (e.g., 401*a*-401*i*) (see, for example, FIGS. 4A-4H) on a first side of each conduit 410 (e.g., 410*a*-410*i*) within a cartridge 400. In one embodiment, a sample specimen 420 is pulled from a sample reservoir 415 disposed on the cartridge 400. In another embodiment, a sample specimen 420 is pulled from a sample input disposed on a surface of the cartridge 400. The material that flows through each channel 110 in the system 10 downstream of the sample reservoir 415 and/or sample input is referred to as the sample 425 can be one or more of a quantity of fluid 150 followed by a quantity of sample specimen 420, it can be one stream of fluid 150 and another separate stream of sample specimen 420, it can be a mixture of fluid 150 and sample specimen 420, it can be only fluid 150, an/or only sample specimen 420, for example. Sample 425 travels through the cartridge 400 and exits each conduit 410 (e.g., 410*a*-410*i*) through the cartridge output 402 (see, for example, FIGS. 4A-4H) on the other side of each conduit 410*a*-410*i*. Thereafter, the sample 425 enters the output tubes 710*a*-710*i*. Sample waste exits the system 10 via tubes 710*a*-710*i* and flows into the fluid output 140.

The system 10 includes one or more fluid control devices for changing at least one fluid property, such as flow, pressure, trajectory, and temperature for example, within the system 10. Fluid control devices can include a valve 300 and a pump 800 that direct and control the flows of various fluids, sample specimens, and samples through the system 10 and over the sensor surface located within the processing device 450. Other fluid control devices include a temperature control device that changes the temperature of the liquid flowing through the system 10. The temperature of the liquid influences and/or controls, for example, the viscosity, fluid density, and speed of sound at which the flows. In general, a fluid control device changes at least one fluid property in the vicinity of at least one surface within the system 10. Generally, this is done to distribute, for example, the magnetic particles along at least a portion of the sensor surface within the processing device 450.

In one embodiment, a valve 300 for the analyte processing system is located between the fluid input 120 and the cartridge 400. Referring now to FIGS. 1, 3A, 3B, 3D, and 3E the valve 300 pinches a portion of the tubes 210*a*-210*i* to enable and disable fluid 150 and/or sample specimen flow through the tubes 210*a*-210*i* and, likewise, through a portion of the channels 110*a*-110*i*. The valve 300 has an enclosure 399 having a first side 301 and a second side 302 adjacent to and substantially parallel to the first side 301. A first end 303 is disposed between and is substantially perpendicular to the first side 301 and the second side 302, and a second end 304 is disposed between and is substantially perpendicular to the first side 301 and the second side 302. The first side 301 has one or more teeth 308 and at least one groove 310 adjacent each of the teeth 308. For example, in one embodiment, the first side 301 has a plurality of valve input grooves 310 and the second side 302 has a plurality of valve output 314 grooves. In one embodiment, the valve 300 has a first side 301 with a row of teeth 308*a*-308*i* and a row of grooves 310*a*-310*i* across from a second side 302 with a second row of teeth 312*a*-312*i* and a second row of grooves 314*a*-314*i*. In one embodiment, the first valve input groove 310*a* and the first valve output groove 314*a* each hold a portion of a channel 110*a*. Accordingly, the grooves (e.g., 310, 314) are sized to hold the outer diameter of the tube (e.g., 210) and/or the outer diameter of the channel (e.g., 110). In one embodiment, the grooves 310, 314 are sized to avoid exerting a force on the input tubes 210 that might change the geometry of the input tube 210. In this way, occlusion of flow through the tubes 210 by the grooves 310, 314 is avoided. Rather, the grooves merely hold the input tubes in their desired position. The grooves 310, 314 can range in size and have a value within the range of from about 0.05 inches to about 0.15 inches, from about 0.08 inches to about 0.11 inches, or about 0.09 inches. The grooves 310, 314 can also range in size and have a value of from about 0.088 inches to about 0.1 inches.

Figure 3B:
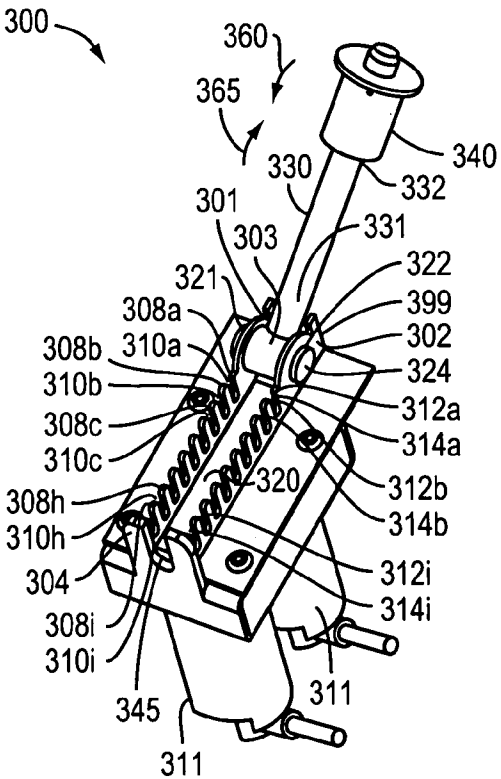
FIG. 3B is a top view of the valve of FIG. 3A.

In one embodiment, referring now to FIGS. 1 and 3B, a tube 210*a* is positioned such that a portion of the tube 210*a* is disposed in the first valve input groove 310*a* and another portion of the tube 210*a* is disposed in the first valve output groove 314*a*, thus each groove (e.g., 310*a*, 314*a*) holds a portion of the tube 210*a*. In this way, a segment of the tube 210*a* is disposed between the first valve input groove 310*a* and the first valve output groove 314*a*. In one embodiment, the tube 210*a* is a portion of the channel 110*a*.

In another embodiment, referring still to FIGS. 1 and 3B, a second valve input groove 310*b* is disposed adjacent the first valve input groove 310*a* and a second valve output groove 314*b* is disposed adjacent the first valve output groove 314*a*. A second tube 210*b* is positioned such that a portion of the second tube 210*b* is disposed in the second valve input groove 310*b* and another portion of the tube 210*b* is disposed in the second valve output groove 314*b*. Optionally, additional input tubes 210 are disposed through one or more of the remaining valve input grooves 310 and valve output grooves 314. In one embodiment, a segment of each of the input tubes (e.g., 210*a*-210*i*) is disposed between a valve input groove (e.g., 310*a*-310*i*) and a valve output groove (e.g., 314*a*-314*i*).

The valve input tubes 210 have an outer diameter that ranges in size depending on, for example, the requirements of a particular assay. The outer diameter of the valve input tube 210 has a value within a range that measures from about 0.05 inches to about 0.15 inches, from about 0.08 inches to about 0.11 inches, or about 0.09 inches. The outer diameter of the valve input tube 210 can also have a value within a range that measures from about 0.088 inches to about 0.1 inches. The valve input tubes have an inner diameter, through which fluid can flow, that have a value within a range that measures from about 0.015 inches to about 0.06 inches, from about 0.020 inches to about 0.035 inches, or about 0.0275 inches.

The valve 300 includes a dowel 330. In one embodiment, the first end 331 of the dowel 330 fastens to the first end 303 of the enclosure 399 and the second end 332 of the dowel 330 fastens to the second end 304 of the enclosure 399. In another embodiment, referring to FIGS. 3A, 3B, 3D, and 3E, each side 301, 302 of the enclosure has an opening 321, 322, respectively. A first end 331 of the dowel 330 is fastened to the first side 301 and the second side 302 to provide the first end 303. Alternatively, a first end of a rod 324 is inserted through an aperture at the first end 331 of the dowel 330. For example, a first end of a rod 324 is inserted through three openings: an opening 321 in the first side 301 of the enclosure 399, an aperture at the first end of 331 of the dowel 330, and then the opening 322 in the second side 302 of the enclosure 399. The rod 324 can be secured within each opening 321, 322 by sizing the rod 324 to provide a tension fit or a press fit such that the outer diameter of the rod 324 is larger than the inner diameter of one or more opening 321, 322, and/or the aperture at the first end 331 of the dowel 330. Alternatively, the rod 324 can be secured by retaining rings, nuts, caps, screws or other suitable fasteners on each of the first end and the second end of the rod 324. For example, a retaining ring is attached to the first end of the rod 324 adjacent the first side 301 and a second retaining ring is attached to the second end of the rod 324 adjacent the second side 302.

A handle 340 is disposed at the second end 332 of the dowel 330. At the second end 304 of the enclosure 399, at the end of the sides 301 and 302 opposite the rod 324, is a locking member 345. In one embodiment, the handle 340 is moved in the direction 360 (i.e., pushed and/or pulled such that it rotates together with the dowel 330 about the rod 324 toward the locking member 345) and the handle 340 engages within the locking member 345. In another embodiment, the handle 340 is moved in the direction 360 and the dowel 330 engages with the locking member 345. Optionally, the dowel 330 does not have a handle 340.

Figure 3A:
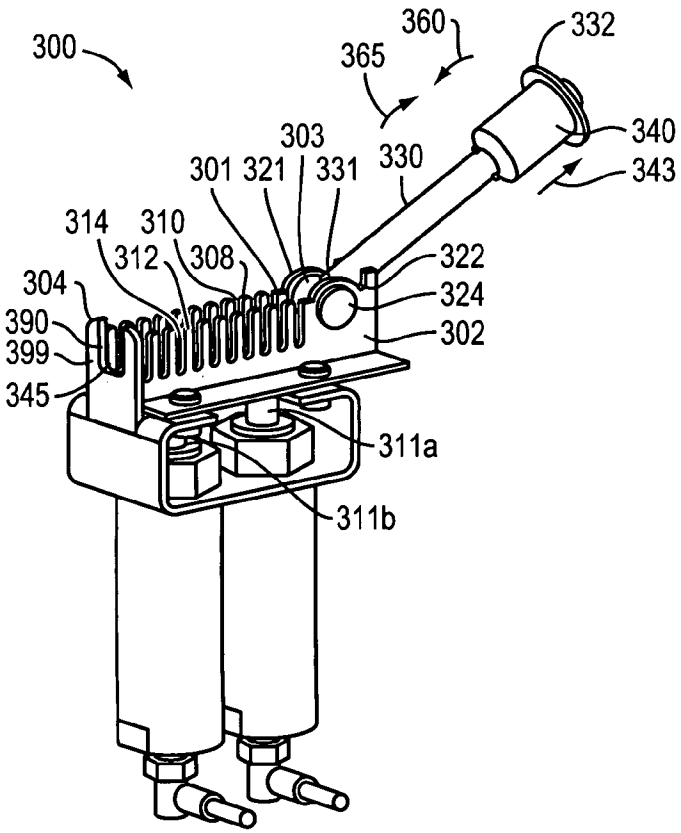
FIG. 3A is a side view of a valve.

In one embodiment, referring to FIGS. 3A and 3B, the locking member 345 is approximately "U" shaped 390 and the handle 340 and/or the dowel 330 is sized to fit within the "U" shape 390. In one embodiment the "U" shape 390 has tapered ends like the shape of a horse shoe. In one embodiment, the handle 340 has an internal spring that exerts a force against locking member 345 when the dowel 330 is in the locked position. When the handle 340 and/or the dowel 330 is pushed in the direction 360 the circumference of the dowel 330 fits into the approximately "U" shaped locking member 345. In one embodiment, the spring loaded handle 340 moves to ensure that the circumference of the dowel 330, which is smaller than the circumference of the handle 340, fits into the approximately "U" shaped locking member 345. The spring loaded handle 340 pushes against the approximately "U" shaped locking member 345. The handle 340 and/or the dowel 330 is held within the void of the "U" shape. Generally, the "U" shape is sized to hold the outer diameter of the dowel 330. For example, the "U" shape has a diameter value within the range that measures from about 0.3 inches to about 0.5 inches, from about 0.35 inches to about 0.4 inches, or about 0.375 inches. The cylindrical external surface of the dowel 330 can have an outer diameter that has a value within the range that measures from about 0.3 inches to about 0.5 inches, from about 0.35 inches to about 0.4 inches, or about 0.375 inches. The handle 340 has an outer diameter with a value within the range that measures from about 0.3 inches to about 0.8 inches, from about 0.4 inches to about 0.75 inches, or about 0.5 inches.

The handle 340 has an internal spring that exerts a force against locking member 345 when the dowel 330 is in the locked position. The dowel 330 is designed to release from locking member 345 when, for example, the handle 340 is pulled in direction 343. Once free, the dowel is rotated in direction 365. The force in direction 365 can be a pulling force and/or a pushing force. The handle 340 and/or the dowel 330 rotates in the direction opposite the locking member 345 (e.g., the handle is pushed and/or pulled such that the handle rotates together with the dowel 330 about the rod 324 in a direction opposite the locking member 345).

Figure 3C:
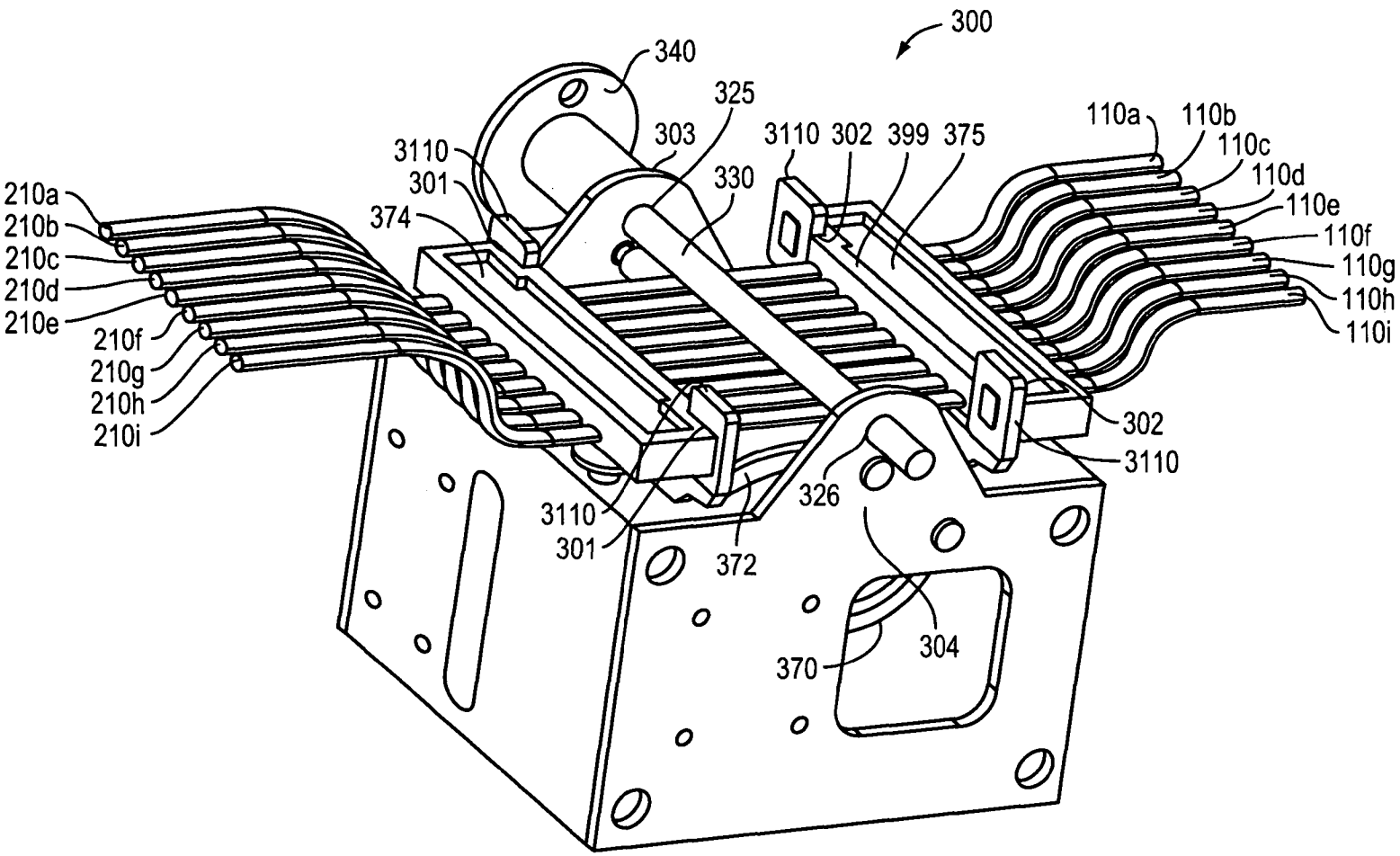
FIG. 3C is a view of another embodiment of a valve.
Figure 3D:
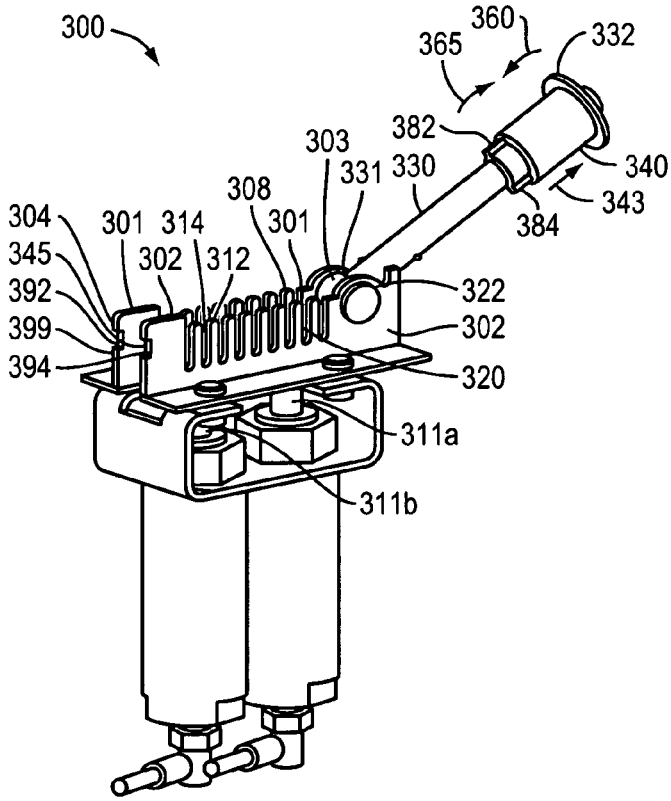
FIG. 3D is a side view of another embodiment of a valve.
Figure 3E:
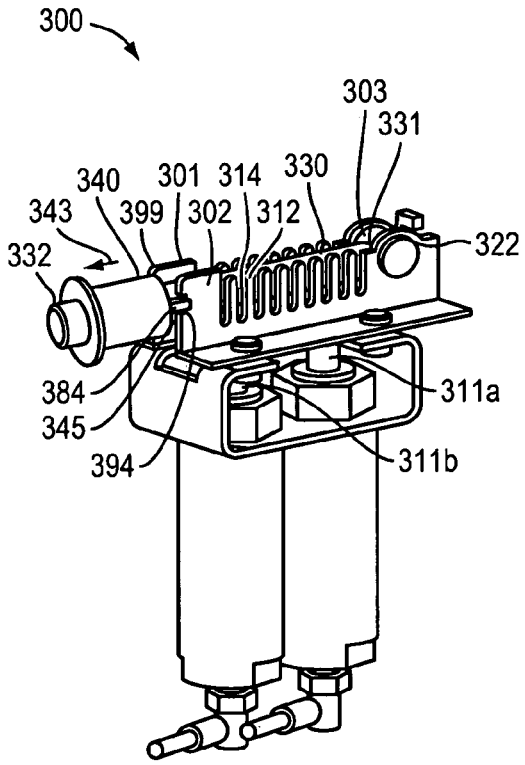
FIG. 3E is a side view of the valve of FIG. 3D.

In another embodiment, referring to FIGS. 3D and 3E, the handle 340 has one or more locking teeth. For example, the handle 340 has two locking teeth 382, 384, respectively. In one embodiment, the locking teeth 382, 384 are disposed on the handle 340, for example, horizontally on substantially opposite sides of the handle 340. The locking teeth 382, 384 have a width value that measures from between about 0.05 inches to about 0.3 inches, from about 0.1 inches to about 0.2 inches, or about 0.17 inches. The locking teeth 382, 384 have a depth value that measures from between about 0.05 inches to about 0.2 inches, or about 0.1 inch deep. The locking member 345 includes one or more notches complementary to the locking teeth 382, 384. For example, the locking member 345 has two notches 392, 394 complementary to the locking teeth 382, 384. The two notches 392, 394 are disposed, for example, on sides 301 and 302, respectively.

The handle 340 has an internal spring that exerts a force between the locking teeth 382, 384 and the two notches 392, 394 of the locking member 345 when the dowel 330 is in the locked position. The dowel 330 is designed to release the locking teeth 382, 384 from the notches 392, 394 of the locking member 345 when, for example, the handle 340 is pulled in direction 343. Once free, the dowel 330 is rotated in direction 365.

A pin 320 is disposed within the enclosure 399 beneath the dowel 330. Specifically, the pin 320 is disposed in between the first row of grooves 310*a*-310*i* and the second row of grooves 314*a*-314*i*. The pin 320 is also disposed between the first end 303 and the second end 304. The valve 300 includes a pusher to push the pin 320 toward a fastened dowel 330. The pusher can be, for example, a piston 311 disposed adjacent the pin 320. In one embodiment, at least two pistons 311*a*, 311*b* are disposed adjacent the pin 320. In one embodiment, the pin 320 is surrounded by the first side 301, the second side 302, the first end 303, and the second end 304 of the enclosure 399.

The valve 300 and its various components including, for example, the pin 320, the dowel 330, the handle 340, the sides 301, 302, the ends 303, 304, and the locking member 345, for example, made be made from any of a variety of materials. Non limiting examples of suitable materials include metals, polymers, elastomers, and combinations and composites thereof.

Referring now to FIGS. 1, 3A, 3B, 3D, and 3E one or more of the tubes 210*a*-210*i* are laced through the first row of grooves 310*a*-310*i* and the second row of grooves 314*a*-314*i*. For example, a portion of the tube 210*b* is laced through the groove 310*b* and another portion of the tube 210*b* is laced through the groove 314*b* such that the tube 210*b* is draped across the pin 320. In one embodiment, one tube (e.g., 210*a*) is first laced through a groove (e.g., 310*a*) in the first row of grooves and then laced through a groove (e.g., 314*a*) in the second row of grooves such that one tube (e.g., 210*a*) is positioned in a groove on each side (e.g., 310*a*, 314*a*). A segment of the tube 210 is disposed between a valve input groove 310 and a valve output groove 314. The dowel 330 is moved in the direction 360 and is engaged with the locking member 345. A pusher pushes the pin 320 toward the fastened dowel 330. For example, pistons 311*a*, 311*b* push fluid, for example, air, to thrust the pin 320 toward the engaged dowel 330. Once the pusher (e.g., pistons 311) is actuated, the tubes 210*a*-210*i* that are located between the pin 320 and the dowel 330 are pinched between the fastened dowel 330 and the pushed pin 320. The pinching action of the dowel 330 and the pushed pin 320 can block all or a portion of fluid from flowing through each tube 210 at the segment of the tube 210 that is pinched.

Figure 7A:
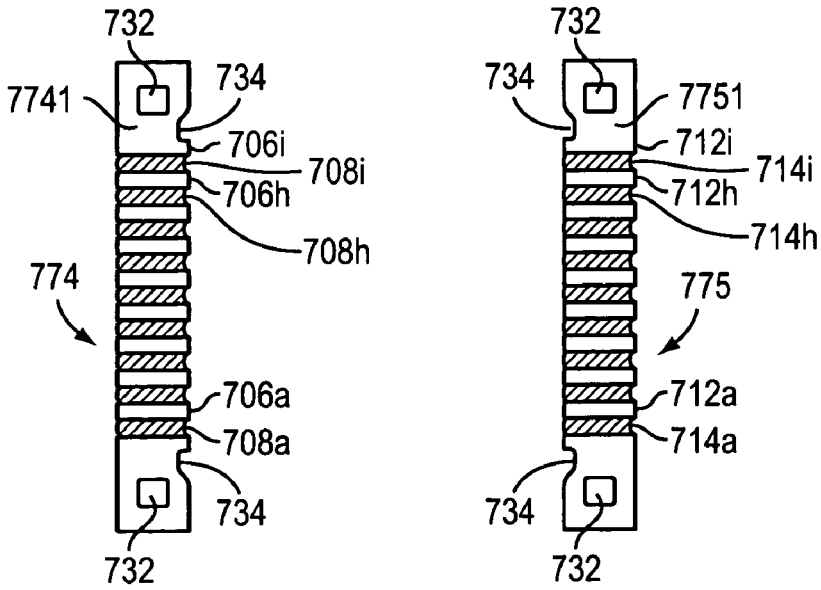
FIGS. 7A-7B show a top view and a bottom view of grips that can be used to hold a portion of a channel.
Figure 7B:
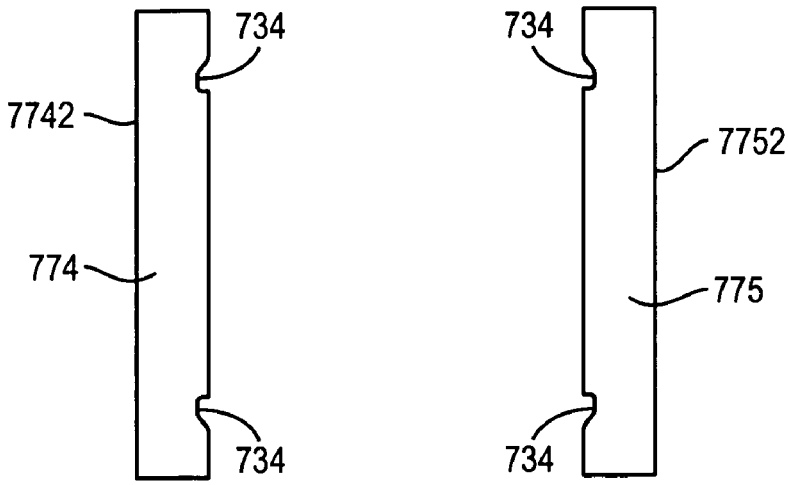
Figure 7C:
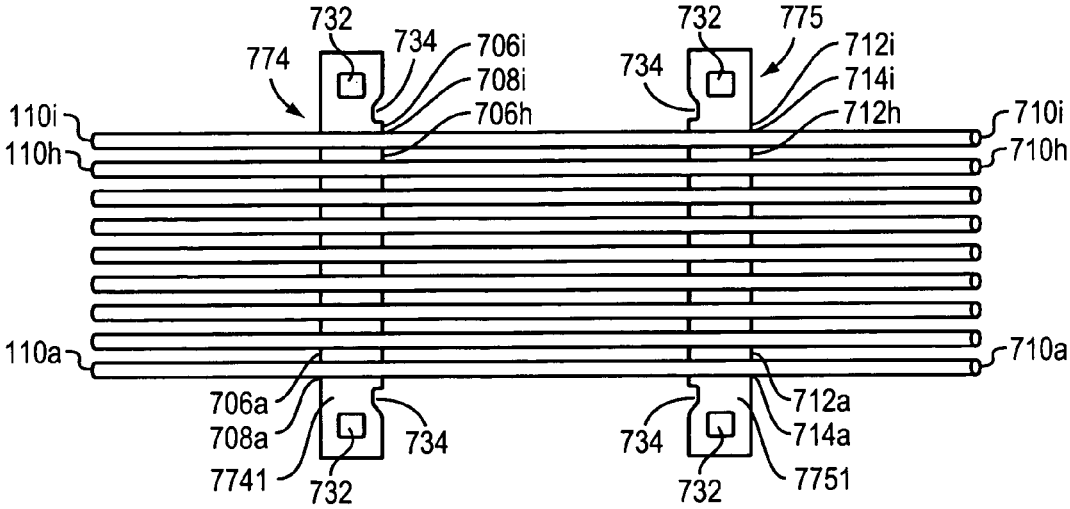
FIGS. 7C-7D show a top view and a bottom view of grips that hold portions of channels.
Figure 7D:
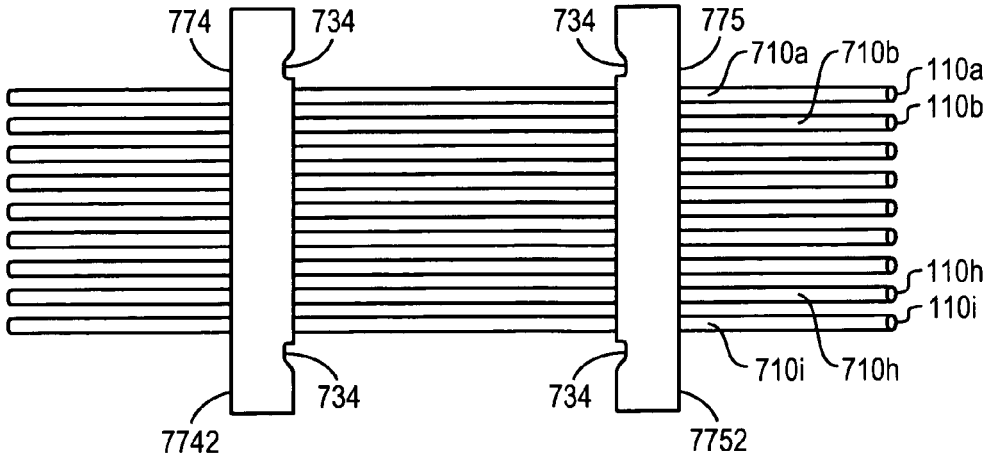

Referring now to FIG. 3C, in another embodiment, the valve 300 has an enclosure 399 with a first side 301 and a second side 302 adjacent to and substantially parallel to the first side 301. A first end 303 is disposed between and is substantially perpendicular to the first side 301 and the second side 302, and a second end 304 is disposed between and is substantially perpendicular to the first side 301 and the second side 302. The first end 303 has a first opening 325 and the second end 304 has a second opening 326. One end of the dowel 330 is inserted through the first opening 325 over a space and then is inserted into the second opening 326. Thereafter, the dowel 330 is positioned between the first opening 325 and the second opening 326. Optionally, the second end of the dowel 330 has one or more handles 340 that prevents the dowel from slipping through the openings (e.g., 325, 326). Additionally, once positioned in the openings 325, 326 a dowel 330 can be secured in place by, for example, internally spring loaded ball detents, nuts, caps, screws or other suitable fasteners on, for example, the second end of the dowel 330. For example, the dowel 330 first end is secured to the first end 303 opening 325 and the dowel 330 second end is secured to the second end 304 opening 326. A mechanical cam device 370 includes a wheel 372 that when actuated turns about the axis of the wheel 372. In one embodiment, the tubes 210*a*-210*i* are held between a first side 301 and a second side 302. A portion of the first side 301 can include a first grip 374 and a portion of the second side 302 can include a second grip 375 (grips are described in greater detail in connection with FIGS. 7A and 7B). In one embodiment, the dimensions of grips 374, 375 are sized and/or shaped to interlock with one or more arm 3110. For example, referring to FIG. 3C, the grip 374 interlocks with two arms 3110 to form the first side 301 and, likewise, the grip 375 interlocks with two arms 3110 to form the second side 302. In one embodiment, a portion of a grip (e.g., 375) is sized such that it is secured within an aperture in the arm 3110. Alternatively, or in addition, the grip (e.g., 375) is sized and shaped such that portions of the grip curve about the arm 3110 and are held against the arm 3110 by an applied force. Suitable applied forces can include the force exerted by tension fit input tubes 210 that are disposed between two grips 374, 375 and are held against the arms 3110 by the force of the tension. The cam device 370 pinches tubes 210*a*-210*i* disposed between the wheel 372 and the dowel 330.

Figure 4A:
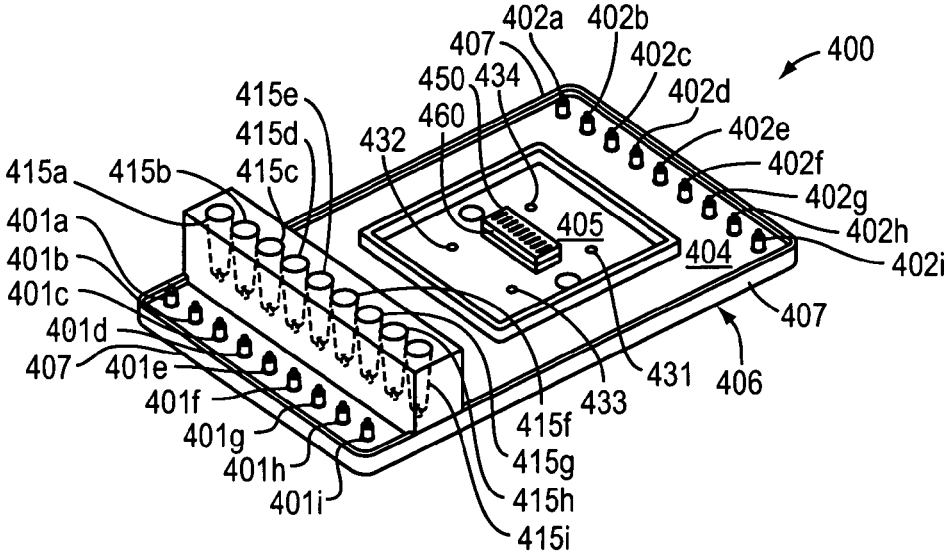
FIG. 4A is a view of a cartridge having a plurality of sample reservoirs.
Figure 4B:
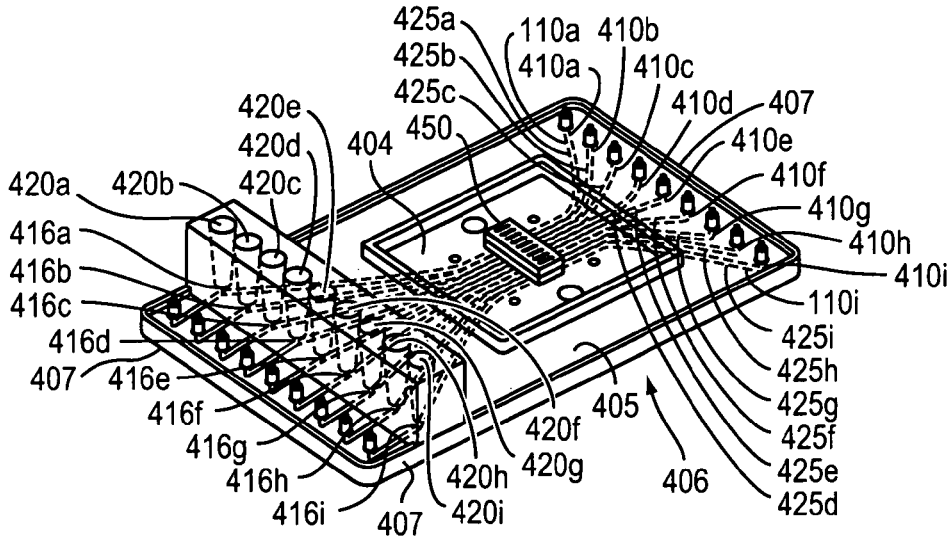
FIG. 4B is a view of a cartridge having a plurality of sample reservoirs and a plurality of conduits.

Referring now to FIGS. 1 and 2 downstream of the valve 300 is a cartridge 400, a plate 500, and a shell 600. When the shell 600 is in the closed position it covers at least a portion of a cartridge 400, which is located on a supporting surface. The supporting surface can be, for example, the top surface of the housing 100 or a plate 500 disposed on the top surface of the housing 100. In one embodiment, the cartridge 400 is placed on the plate 500, which is disposed on the top surface of the housing 100 (e.g., the plate 500 can sit on the top surface of the housing 100). FIGS. 4A-41 show the cartridge 400 for processing an analyte sample. Referring to FIGS. 4A and 4B, the cartridge 400 includes a processing device 450 for processing the analyte sample and a body 404. The body 404 has a surface (e.g., a top surface 405 and a bottom surface 406) and is bounded by at least one edge 407. A plurality of positioning members are defined by one or more surfaces of the body 404 and the positioning members align the processing device 450 relative to the body 404. A conduit 410 is defined by the body 404 between a cartridge input 401 and an cartridge output 402. The plurality of positioning members align the processing device 450 relative to the conduit 410.

A single edge can surround the body 404 in the shape of, for example, a circle. Alternatively, multiple edges 407 surround the body 404 to form a square, a triangle or a rectangle, for example.

The cartridge 400 can feature a plurality of positioning members, which are defined by one or more surfaces of the body 404. The positioning members can include, for example, apertures defined by the body 404 of the cartridge 400 and/or pins disposed on the body 404 of the cartridge 400. In one embodiment, a positioning aperture mates with a positioning pin. The positioning aperture can extend throughout the surface of the body 404 to provide an opening that goes through the body 404 or, alternatively, can be a cavity that is open from one of the top surface 405 or the bottom surface 406 of the body 404. For example, the cartridge 400 has one or more positioning apertures 431, 432, 433, 434. The positioning apertures (e.g., 431) are apertures defined by the surface of the body 404 that mate with a complementary positioning pin. In another embodiment, the cartridge 400 has one or more positioning pins disposed on a surface of the body 404, for example, on the top surface 405 of the body 404. Positioning pins mate with complementary positioning apertures.

The positioning members align the processing device 450 relative to the body 404 and/or the conduit(s) 410 defined by the body 450. For example, the positioning members ensure that the processing device 450 is positioned in a desired location relative to the body 404 of the cartridge 400 and/or the conduits 410 defined by the body 404. In one embodiment, the processing device 450 is disposed on the top surface 405 of the body 404 of the cartridge 400 and the positioning members align the body 404 and the processing device 450 in a position where the information available in the processing device 450 can be processed.

Referring to FIGS. 1, 2, 4A and 4B, in at least one embodiment, the junction in the channel 110 where the input tube 210 meets the cartridge 400 cartridge input 401 is constructed and arranged to allow repeatable connection and disconnection. Similarly, the junction where the output tube 710 meets the cartridge output 402 is constructed and arranged to allow repeatable connection and disconnection. In one embodiment, these junctions are constructed and arranged to require tools for connection and disconnection, such as threaded couplings that require a wrench or other such tool to affect the coupling and decoupling. In other embodiments, these junctions are constructed and arranged to allow quick and easy manual connection and disconnection, without any extra tools or accessories. Such couplings, both requiring and not requiring tools, are known in the art. In some embodiment, there are multiple cartridge inputs 401 and cartridge outputs 402. In some embodiments, one or more cartridge input 401 and/or cartridge output 402 are part of the cartridge 400. In one embodiment, an end of the input tube 210 is sized to mate with the cartridge input 401 and likewise an end of the output tube 710 is sized to mate with the cartridge output 402.

Fluid and/or sample specimen provide a sample 425 that travels through one or more conduits 410*a*-410*i* within the cartridge 400. Each conduit 410 is located between the cartridge input 401 and the cartridge output 402. Fluid enters a cartridge input 401*a*-401*i*, flows through the conduit 410*a*-410*i*, and exits the cartridge output 402*a*-402*i*.

Figure 4C:
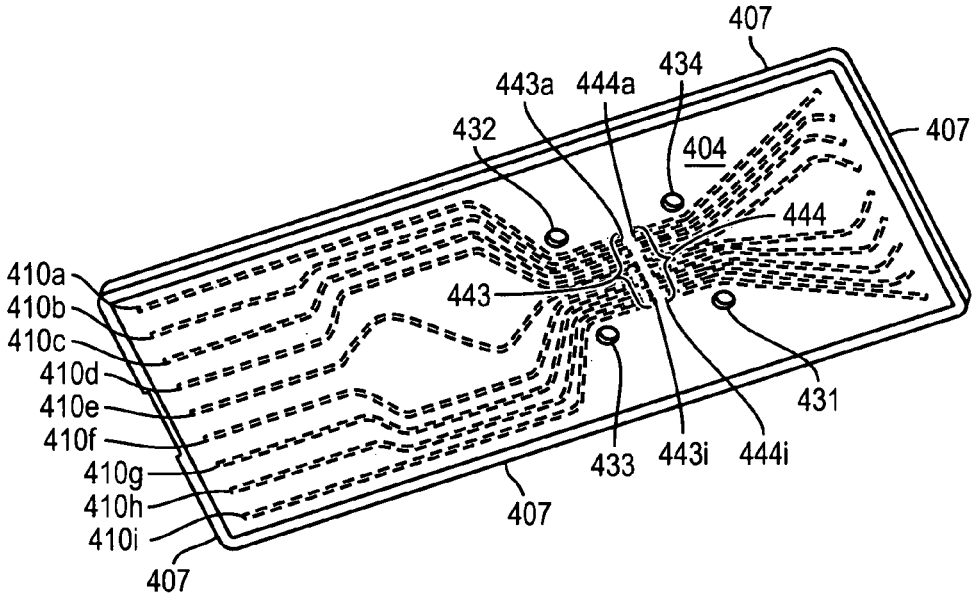
FIG. 4C is a view of a cartridge having a plurality of conduits.

The conduits 410 can have a diameter range of from about 0.05 mm to about 1 mm, or about 0.5 mm. Referring also to FIG. 4C, the conduit 410*a*-410*i* may be sized so that each conduit 410 provides at least substantially the same length. For example, conduit 410*a* has substantially the same length as conduit 410*e*. The conduit 410 lengths can have a value within the range of from about 1.5 inches to about 6 inches, from about 3 inches to about 5 inches, or about 4 inches. In another embodiment, the conduit 410*a*-410*i* is sized so that each conduit 410 provides at least substantially the same flow velocity. In certain embodiments, consistent conduit to conduit flowrate delivery is required to enable parallel analysis. For example, conduit 410*a* has substantially the same flow velocity as conduit 410*e*. The conduit 410 flow velocities can have a value within the range of from about 0.001 inches per second to about 12 inches per second, from about 0.1 inches per second to about 6 inches per second, or about 3 inches per second. Carefully sizing two of more of the conduits 410 to have substantially the same length and substantially the same flow velocity enables parallel analysis of samples that flow through the conduits 410 within the cartridge 400. For example, by ensuring a consistent length and flow velocity the same sample can be simultaneously evaluated multiple times under substantially the same conditions. Each conduit 410 (e.g., 410*a*) can be sized to process a small quantity of sample, for example, 10 micro liters, thereby enabling only a small quantity of sample specimen to be obtained from the subject. In one embodiment, 45 micro liters of a patient body fluid sample specimen is divided evenly between nine conduits 410*a*-410*i* defined by the body 404 of a cartridge 400 and the sample in each conduit is simultaneously processed by a processing device 450.

Figure 4D:
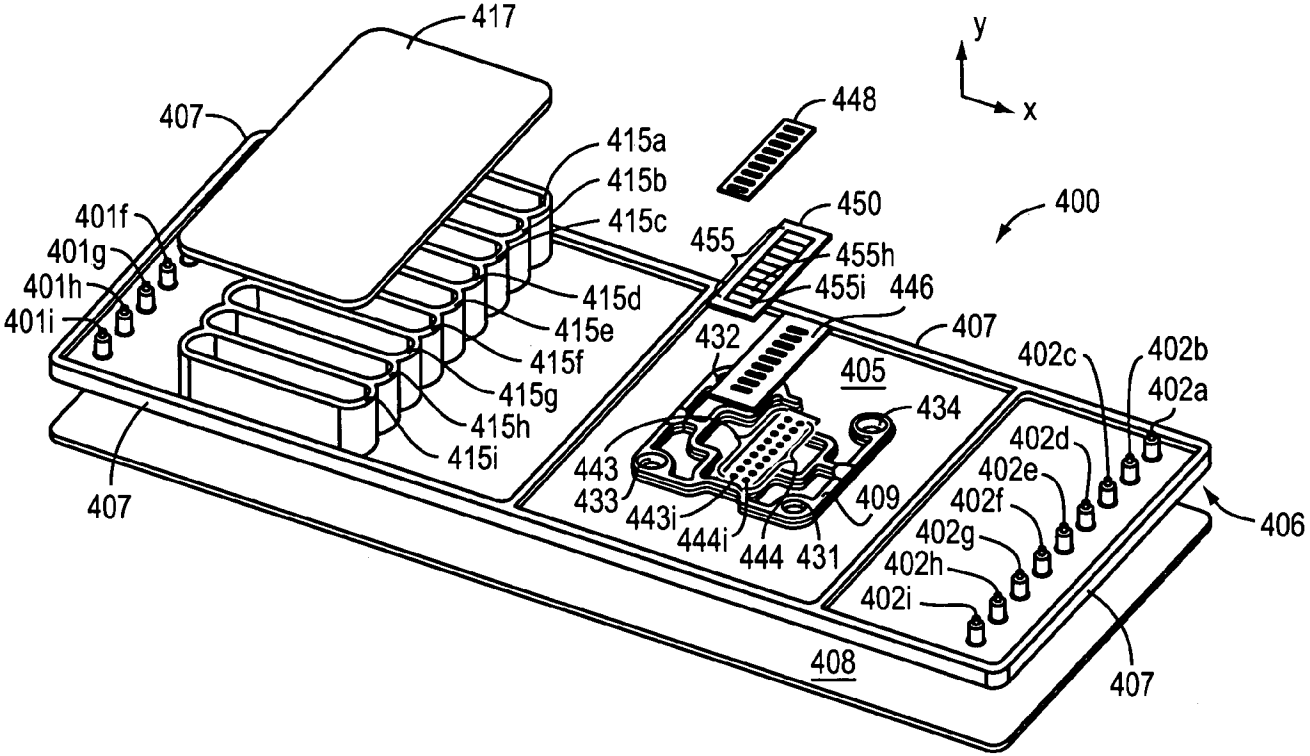
FIG. 4D is a view of a cartridge having a plurality of cartridge inputs, a plurality of sample reservoirs, a reservoir cover, a plurality of cartridge outputs, and a processing device.
Figure 4E:
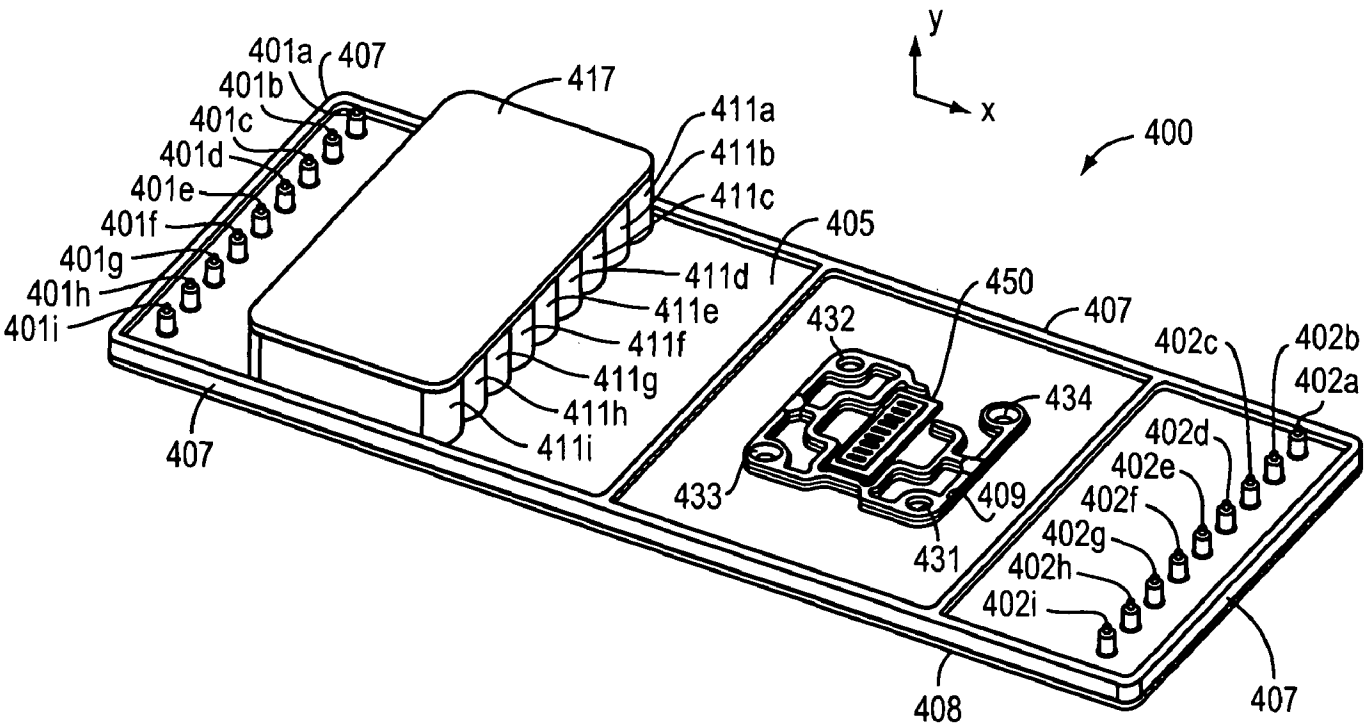
FIG. 4E is a view of a cartridge having a plurality of cartridge inputs, a plurality of sample reservoirs, a reservoir cover, a plurality of cartridge outputs, and a processing device.

Referring also to FIGS. 4D and 4E, the cartridge 400 has a sample input 411 disposed relative to the conduit 410. In one embodiment, referring to FIGS. 4A, 4B, 4D and 4E, the sample input includes one or more sample reservoirs 415*a*-415*i* disposed on the body 404 (e.g., on the top surface 405 of the body 404 in a position relative to one or more conduits 410*a*-410*i*). Fluid travels through one or more conduits 410*a*-410*i* within the cartridge 400. Each conduit 410 is defined in the body 404 between the cartridge input 401 and the cartridge output 402. Fluid enters a cartridge input 401*a*-401*i*, flows through the conduit 410*a*-410*i*, and exits the cartridge output 402*a*-402*i*. Fluid is pumped through the conduit 410*a*-410*i*. In one embodiment, the fluid does not travel through the conduit via capillary action. The cartridge input 401*a*-401*i* can be disposed on a top surface 405 of the body 404, for example.

In one embodiment, a fluid 150 is pulled via a pump into the cartridge input 401*a*-401*i*, enters the conduit 410*a*-410*i* and is pulled into the conduit 410*a*-410*i*. A sample specimen (e.g., 420*a*-420*i*) in a sample reservoir 415*a*-415*i* is pulled into the conduit 410*a*-410*i* through an end (e.g., 416*a*-416*i*) of the sample reservoir 415*a*-415*i*. Optionally, one or more sample reservoir 415*a*-415*i* is covered by a reservoir cover 417. The reservoir cover 417 can cover the sample specimen 420 disposed in the sample reservoir 415 to avoid, for example, contamination of the sample specimen 420 by, for example, individuals who interface with the cartridge 400 and/or the system 10 (see FIG. 1). In one embodiment, the reservoir cover 417 removably covers the sample reservoir 415. In one embodiment a removable reservoir cover 417 seals the sample reservoirs 415*a*-415*i* and additionally functions as a valve that allows or prevents fluids in sample reservoir 415*a*-415*i* from flowing to the sensor. Removing the reservoir cover 417 can, for example, allow fluid in sample reservoir 415*a*-415*i* to flow towards the processing device 450 when a pump 800 (e.g., a downstream pump) is running. In an embodiment where the contents of sample reservoir 415*a*-415*i* are intended to be the sole fluid flowing towards the processing device 450, then the cartridge inputs 401*a*-401*i* are pinched off by a valve 300 for example, a pinch valve disposed upstream of the cartridge 400.

The sample input 411 can be at the end 416 of the sample reservoir 415, for example. In one embodiment, the end 416 of the sample reservoir 415 through which the sample specimen 420 enters the conduit 410 is shaped and/or sized to consistently provide the sample specimen 420 to the conduit 410. For example, the end 416 of the sample reservoir 416 has a funnel shape and an opening, through which the sample specimen 420 enters the conduit 410, is disposed at the bottom of the funnel.

Figure 4F:
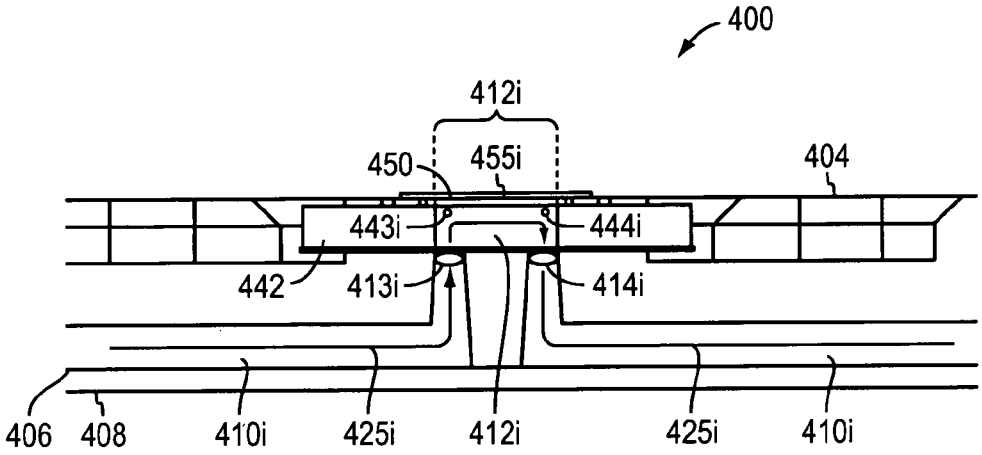
FIG. 4F is a cross section of a cartridge and a processing device.
Figure 4G:
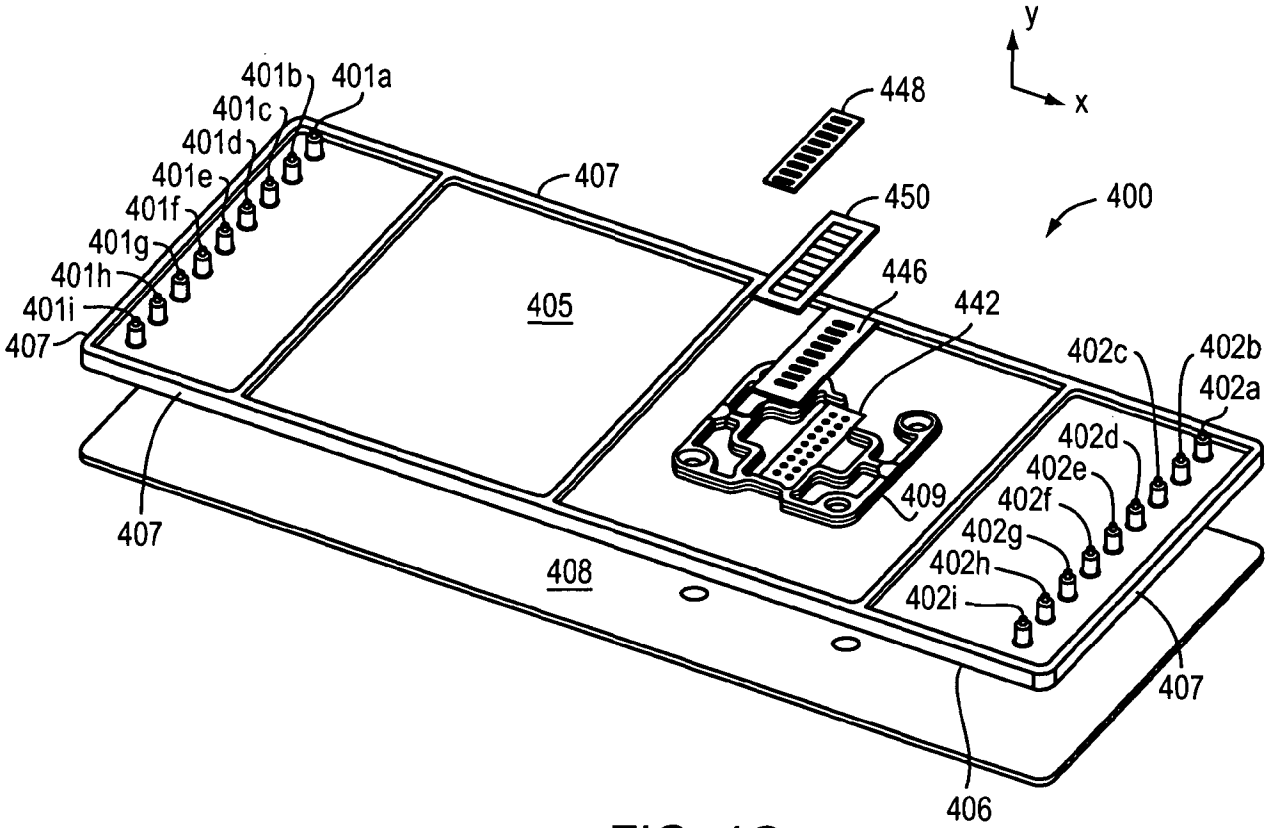
FIG. 4G is a view of a cartridge having a plurality of cartridge inputs, a plurality of cartridge outputs, and a processing device.
Figure 4H:
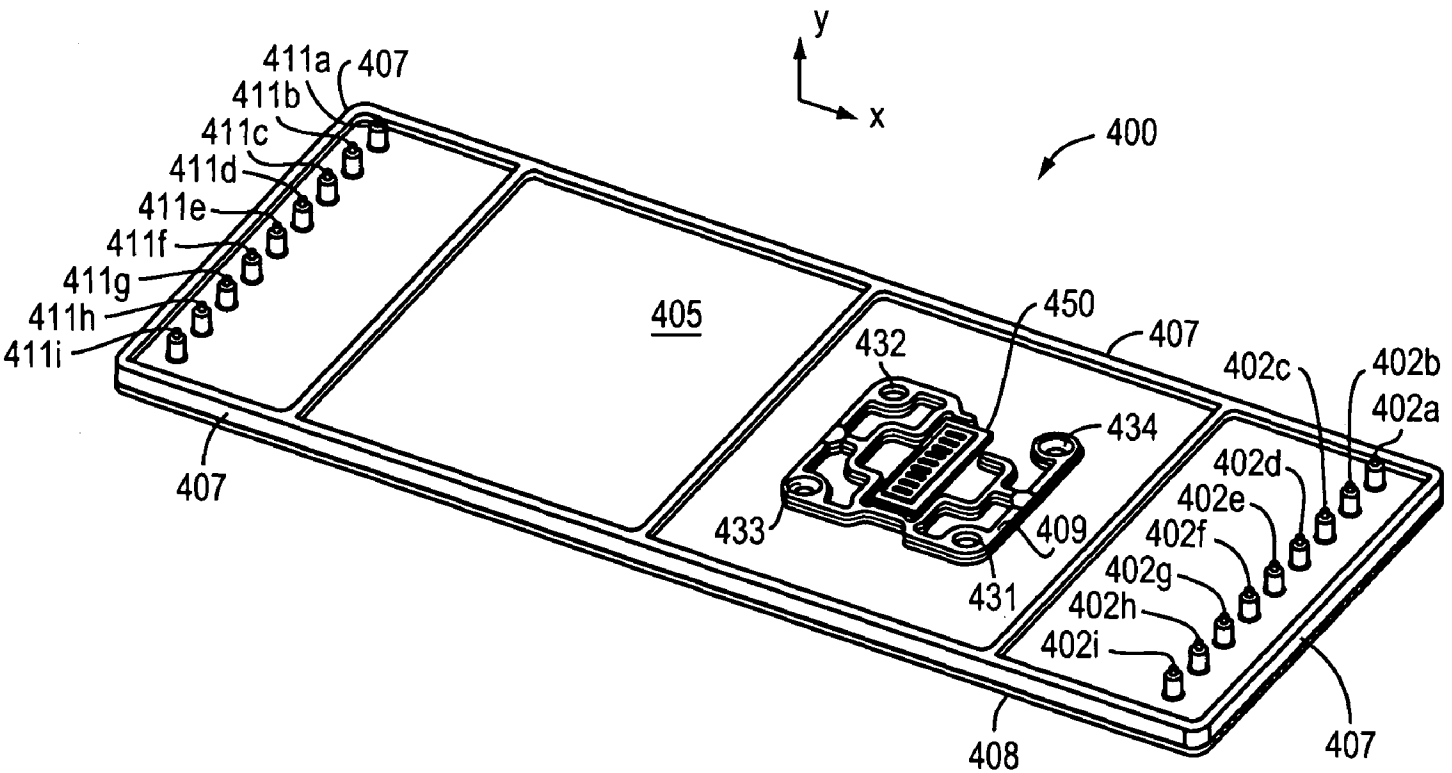
FIG. 4H is a view of a cartridge having a plurality of cartridge inputs, a plurality of cartridge outputs, and a processing device.

FIGS. 4G and 4H provide another embodiment of a cartridge 400 body 404. Like the cartridge 400 body 404 described with reference to FIGS. 4A-4D, the cartridge 400 includes a processing device 450 for processing the sample and a body 404. The body 404 has a surface and is bounded by at least one edge 407. A plurality of positioning members are defined by one or more surface of the body 404 and the positioning members align the processing device 450 relative to the body 404. A conduit 410 is defined by the body 404 between a cartridge input 401 and an cartridge output 402. In one embodiment, the plurality of positioning members align the processing device 450 relative to the conduit 410 defined by the body 404 between a cartridge input 401 and an cartridge output 402.

The cartridge 400 can feature a plurality of positioning members, which are defined by one or more surface of the body 404. The positioning members can include, for example, positioning apertures (e.g., 431, 432, 433, 434) defined by the body 404 of the cartridge 400 and/or pins disposed on the body 404 of the cartridge 400. The cartridge input 401 and the sample input 411 can be a single input. The fluid and/or the sample specimen can be provided to the conduit 410 via this single input.

In one embodiment, the fluid 150 mixes with the sample specimen 420 to provide a sample 425. In another embodiment, the fluid 150 provides one layer within the conduit 410 and the sample specimen 420 provides another layer within the conduit 410 and the flow through the conduit 410 after the point in the conduit 410 where the cartridge input 401 and the sample input 411 have been provided is referred to as the sample 425. In still another embodiment, the fluid 150 is physically separate from the sample specimen 420, however, after the point in the conduit 410 where the cartridge input 401 and the sample input 411 have been provided though physically separate they are referred to as the sample 425. In still another embodiment, after the point in the conduit 410 where the cartridge input 401 and the sample input 411 are provided the sample 425 includes, for example, a section of fluid (e.g., 150) and then a section of sample specimen (e.g., 420) or where there is no sample specimen in the sample input 411 the sample 425 is composed only of the fluid (e.g., 150). While traveling through the conduit 410, the sample 425 is processed by the processing device 450 and thereafter the sample 425 exits the cartridge 400 via the cartridge output 402.

A processing device 450 for processing the sample 425 is disposed on the cartridge 400. For example, in one embodiment, the processing device 450 is disposed on a surface of the body 404. In one embodiment, at least a portion of the processing device 450 is surrounded by a raised surface 409 that is part of and/or disposed on the top surface 405 of the body 404. The raised surface 409 is raised above the top surface 405 and has a measurement above the top surface 405 of the body in the Z direction has a value within the range of from about 0.5 mm to about 0.7 mm, or from about 0.55 mm to about 0.65 mm, or about 0.63 mm higher than the top surface 405 of the body 404. The raised surface 409 also has a measurement along the top surface 405 of the body in the X direction that has a value within the range of from about 7 mm to about 25 mm, or from about 20 mm to about 22 mm, or about 21 mm of the top surface 405 of the body 404. The raised surface 409 aids in positioning the processing device 450 for contact (e.g., electrical and/or mechanical contact) with the socket 630 and the cover 600 (discussed in detail together with FIGS. 6A-6G). In one embodiment, the cartridge input 401, the sample reservoir 415, the sample input 411 (e.g., the end 416 of the sample reservoir 415) and the processing device 450 are disposed on a top surface 405 of the cartridge 400. The raised surface 409 protects the processing device 450 from, for example, damage.

In one embodiment of the cartridge 400, a fluid 150 is pulled into the first cartridge input 401*a* and enters the conduit 410*a*, a sample specimen 420*a*, in a sample reservoir 415*a*, is pulled into the conduit 410*a* through an end 416*a* of the sample reservoir 415*a*. Thereafter the conduit 410*a* contains a sample 425*a* that includes a section of fluid 150 followed by a section of sample specimen 420*a* followed by a section of fluid 150. A processing device 450 for processing the sample 425*a* is disposed on the cartridge 400. After being processed by the processing device 450, the sample 425*a* exits the cartridge output 402*a*. In still another embodiment, the cartridge 400 has a second cartridge input 401*b* a second sample reservoir 415*b* and a second conduit 410*b* between the second cartridge input 401*b* and a second cartridge output 402*b*. The fluid 150 is pulled into the second cartridge input 401*b* and enters the second conduit 410*b*. A second sample specimen 420*b* in the second sample reservoir 415*b* is pulled into the second conduit 410*b* through an end 416*b* of the second sample reservoir 415*b*. Thereafter the conduit 410*a* contains a second sample 425*b* that includes a section of fluid 150 followed by a section of second sample specimen 420*b* followed by a section of fluid 150. The processing device 450 processes the second sample 425*b* and the second sample 425*b* exits the second cartridge output 402*b*.

Referring now to FIGS. 4D and 4E, the cartridge 400 body 404 is fabricated by, for example, injection molding. In one embodiment, the body 404 is injection molded to form the cartridge inputs 401, the cartridge outputs 402, and the conduits 410 defined by the body 404 between the cartridge inputs 401 and the cartridge outputs 402. The body 404 has a surface (e.g., a top surface 405 and/or a bottom surface 406) and is bounded by at least one edge 407. Suitable materials that can be employed to make the body 404 includes polymers, for example, polycarbonate. Polycarbonate can be sterilized by irradiation for use with certain samples 425 and in certain assays. The cartridge 400 and its parts including, the conduit 410, the sample reservoir 415, the sample input 411, the cartridge input 401, the cartridge output 402, and the processing device 450 can be formed from a variety of materials, including plastics, elastomers, metals, ceramics, or composites thereof, among other materials.

In order to assemble the cartridge 400, the body 404 is submerged in an ethanol solution containing from about 5% to about 100% ethanol for a time within the range of from about 2 minutes to about 30 minutes. In one embodiment, the conduit 410 is not a tunnel defined through the body 404, but rather is a extended cavity cut through one surface of the body. A surface of the body 404 through which the conduits 410 are disposed and/or cut, for example, the bottom surface 406 of the body 404 is positioned to enable the ethanol solution to drain from the conduit 410. For example, the bottom surface 406 of the body 404 is positioned on a surface, for example, on a non-abrasive tissue (e.g., a Kimwipe®). Optionally, any particles are removed from the bottom surface 406 of the body 404 by cleaning the bottom surface 406 by, for example, blowing an inert gas, such as nitrogen, over the bottom surface 406. A sealing layer 408 is disposed on at least a portion of a surface of the body 404. For example, the sealing layer 408 is disposed on the bottom layer 406 of the body 404. The sealing layer 408 can be a thermal transfer layer. The sealing layer 408 can be a thin layer that measures from about 0.0001 inches to about 0.01 inches, or from about 0.001 inches to about 0.005 inches, for example. The sealing layer 408 allows for fluid thermal conditioning of, for example, wash buffers, the fluid 150, the sample specimen 420 and/or the sample 425, prior to processing by the processing device 450. More specifically, when the sealing layer 408 contacts a thermally controlled surface (e.g., a top surface 504 of a plate 500 that has a temperature control device 520, see FIGS. 5A and 5B) the liquid flowing through the cartridge 400 is thermally conditioned. Thermal conditioning of liquids (e.g., wash buffers, the fluid 150, the sample specimen 420 and/or the sample 425) impacts and/or controls the viscosity, density, and speed of sound of the liquid flowing through the cartridge 400.

In one embodiment, the sealing layer 408 has one or more portions that align with the positioning members defined by the body 404. For example, where the positioning members are positioning apertures (e.g., 431, 432) a portion of the sealing layer 408 that aligns with the positioning apertures also features apertures. In this way, when the sealing layer 408 is disposed on the body 404 a positioning pin will fit into the complementary positioning aperture without resistance. In one embodiment, the sealing layer 408 is a hydrophilic layer. Suitable materials that may be employed as a sealing layer 408 include a hydrophilic tape or a plastic film such as polyester, polycarbonate, polymide, or polyetheridmade with a hydrophilic seal, for example. In one embodiment, the sealing layer 408 provides a wetted surface that is disposed on a surface of the body 404. The sealing layer 408 can be, for example, a hydrophilic tape. In another embodiment, a surface of the body 404 is modified, for example, chemically and/or by introducing a charge to the surface of the body 404. For example, the surface of the body 404 can be treated with a fluid to effect hydrophobic or hydrophilic characteristics on the surface of the body 404.

In one embodiment, the sealing layer 408 is a hydrophilic tape that includes an adhesive. A backing is removed from the hydrophilic tape and is discarded. A region of the hydrophilic tape is aligned with the positioning members defined by the body 404, for example, a plurality of apertures within the hydrophilic tape are aligned with a plurality of positioning apertures (e.g., 431, 432) defined by the body. The adhesive side of the hydrophilic tape (e.g., the sealing layer 408) is pressed onto the bottom surface 406 of the body 404. In one embodiment, the sealing layer 408 is rubbed with a block, for example, a plastic block to ensure that there are no bubbles between the sealing layer 408 and the bottom surface 406 of the body 404. In one embodiment, the body 404 and sealing layer 408 are placed onto a heated surface to ensure that the sealing layer 408 is sealed onto the bottom surface 406 of the body 404. The heated surface can be a hot plate at a temperature within the range of from about 50° C. to about 160° C., from about 80° C. to about 120° C., or about 100° C. The sealing layer 408 and body 404 can be held on the heated surface for a time having a value within the range of from about 20 seconds to about ten minutes, from about 40 seconds to about five minutes, or for about one minute. Optionally, a weight is placed on the body 404 and sealing layer 408 assembly for the time that the assembly is on the heated surface. The assembly is removed from the heated surface and, while still hot, any air pockets located between the sealing layer 408 and the body 404 are removed by, for example, pressing or rubbing the sealing layer 408, for example, with a block that is rubbed over the sealing layer. In one embodiment, any air pockets located between the sealing layer 408 and the bottom surface 406 of the body 404 are removed. Prior to adding the sealing layer 408 to the bottom surface 406 of the body 404, the conduit 410*a*-410*i* has a cross section shaped substantially like the letter "C". Upon adhering the sealing layer to the bottom surface 406 of the body 404 the cross section of the conduit 410*a*-410*i* is shaped substantially like the letter "D".

The processing device 450 is disposed on the body 404. For example, the processing device 450 is disposed on a surface, for example, the top surface 405 of the body 404. The processing device 450 can be flush with the top surface 405 of the body 404. Alternatively, the processing device 450 can be raised above the top surface 405 of the body 404 or located below the top surface 405 of the body 404. In one embodiment, the processing device 450 is a micro-electro mechanical system (MEMS) chip disposed on the body 404. In one embodiment, the processing device 450 is a sensor for sensing the sample 425 in the conduit 410. In another embodiment, the processing device 450 includes a flexural plate wave device (FPW device). In another embodiment, the processing device 450 is a silicon containing chip. In still another embodiment, the processing device 450 is an acoustic device.

The processing device 450 is disposed on a surface of the body 404. Referring now to FIG. 4D, the top surface 405 of the body 404 has a mounting surface 442 and a plurality of sample processing device inputs 443 (e.g., 443*a*-443*i*) and a plurality of sample processing device outputs 444 (e.g., 444*a*-444*i*). Each of the plurality of processing device inputs 443 and processing device outputs 444 align with a conduit 410 defined by the body 404.

FIG. 4F provides a cross section of the body 404 along the length of the conduit 410*i*. The conduit 410*i* has a discontinuity 412*i*, the discontinuity 412*i* is, for example, a break or a breach in the conduit 410*i*. In one embodiment, the discontinuity 412*i* is located substantially adjacent the mounting surface 442. A first portion 413*i* of the conduit 410*i* is upstream of the discontinuity 412*i* and a second portion 414*i* of the conduit is downstream of the discontinuity 412*i*. In one embodiment, the first portion 413*i* makes an angle relative to the remaining portions of the conduit 410*i*. Likewise, the second portion 414*i* makes an angle relative to the remaining portions of the conduit 410*i*. In one embodiment, the position of the first portion 413*i* and the second portion 414*i* closest to the discontinuity 412*i* are adjacent the mounting surface 442.

In one embodiment, the first portion upstream of the discontinuity 413*i* is sized to be smaller than the remaining portions of the conduit 410*i*, for example, it has a cross-sectional area that tapers and is reduced relative to the remaining portions of the conduit 410*i*. Likewise, the second portion downstream of the discontinuity 414*i* is sized to be smaller than the remaining portions of the conduit 410*i*, for example. The second portion 414*i* tapers relative to the remaining portions of the conduit 410*i* and has a cross-sectional area that is reduced relative to the remaining portions of the conduit 410*i*. For example, at the most narrow point, the cross-sectional area of the first portion 413*i* is within a range of from about 0.00007 $in^2$ to about 0.0009 $in^2$, from about 0.00005 $in^2$ to about 0.0004 $in^2$, or about 0.0001 $in^2$. Likewise, at the most narrow point, the cross-sectional area of the second portion 414*i* is within the range of from about 0.00007 $in^2$ to about 0.0009 $in^2$, from about 0.00005 $in^2$ to about 0.0004 $in^2$, or about 0.0001 $in^2$. The size of the first portion 413*i* and the second portion 414*i* can be the same or, alternatively, can differ. The first portion 413*i* and the second portion 414*i* narrows relative to the remaining portions of the conduit 410*i*. The first portion 413*i* and the second portion 414*i* and, for example, the angles relative to the remaining portions of the conduit 410*i* and/or the region of the taper are sized and shaped to ensure flow therethrough. For example, in one embodiment, where the conduit 410*i* is at an angle, the edges of the angle by which the sample 425 passes are smoothed out or chamfered to avoid disturbing the flow of sample 425*i* therethrough.

The mounting surface 442 is cleaned with, for example, liquid ethanol and/or gaseous nitrogen and is dried. A gasket 446 has a plurality of holes or slotted apertures that are sized to complement the processing device inputs 443 and processing device outputs 444 defined by the mounting surface 442. The gasket 446 is a double sided pressure sensitive adhesive film. A release liner is removed from one side of the gasket 446 to reveal a side of the pressure sensitive adhesive film. The gasket 446 is aligned with the mounting surface 442 to ensure that the holes in the gasket 446 align with and do not block the processing device inputs 443 and processing device outputs 444 defined by the mounting surface 442. The gasket 446 is sealed onto the mounting surface 442 on the top surface 405 of the body 404. A seal is formed between the gasket 446 and the mounting surface 442 when there are no visible air pockets therebetween. The other release liner is removed from the gasket 446. The processing device 450 is cleaned and dried with, for example, liquid ethanol, and/or gaseous nitrogen. The processing device 450 is held by at least two edges using duck billed tweezers. Holding the processing device 450 at the edges ensures that the membranes 455 (e.g., membranes including fragile gold portions that are in a FPW device, see, FIGS. 4D and 4I) remain intact. In one embodiment, the processing device has one membrane 455 for each conduit 410 within the body 404 of the cartridge 400. The processing device 450 is placed onto the gasket 446 such that each membrane (e.g., 455*i*) is aligned with its complementary conduit (e.g., 410*i*) at, for example, the processing device input (e.g., 443*i*) and the processing device output (e.g., 444*i*) for its complementary conduit (e.g., 410*i*). In one embodiment, positioning the processing device 450 and, more specifically, the membranes 455 to align with the complementary conduit 410 is aided by at least a portion of the raised surface 409 which, optionally, is sized and shaped to complement the dimensions of the processing device 450 to ensure proper placement of the processing device 450 relative to the mounting surface 442 and the plurality of analyte processing device inputs 443 (e.g., 443*a*-443*i*) and the plurality of analyte processing device outputs 444 (e.g., 444*a*-444*i*). The processing device 450 is pressed into the exposed pressure sensitive adhesive on the gasket 446. The processing device 450 is carefully pressed down to hold the processing device 450 to the pressure sensitive adhesive on the gasket 446 without breaking one or more membranes 455 (e.g., 455*a*-455*i*) on the processing device 450. The processing device 450 is then cleaned with, for example, a cotton swab dipped in ethanol to remove any material on the processing device 450 and/or the membranes 455. An electrode cover 448 is a plastic cover with a pressure sensitive adhesive film on one side. The release liner is removed from the electrode cover 448 to expose the pressure sensitive adhesive. The adhesive side of the electrode cover 448 is aligned with the processing device 450 and is sealed onto the surface of the processing device 450. Optionally, the electrode cover 448 is sealed onto the surface of the processing device 450 with the aid of a microscope that aids in proper placement of the electrode cover 448. In one embodiment, the perimeter of the electrode cover 448 is pressed with, for example, tweezers and/or a pressing device to ensure sealing of the electrode cover 448 to the processing device 450 without damage to membranes 455 located interior to the outer perimeter of the electrode cover 448.

In one embodiment, referring still to FIG. 4F, the discontinuity 412 is a section defined in the body 404 that is substantially parallel with the top surface 405 of the body 404. The discontinuity 412 is defined adjacent (e.g., beneath) the mounting surface 442. Sample 425*i* that flows through the conduit 410*i* increases in flow velocity as the sample 425 travels through the restricted size of the first portion 413*i*. The sample 425*i* then flows at the increased velocity through the discontinuity 412*i*. After passing through the discontinuity 412*i* the sample 425*i* enters the second portion 414*i* and continues its travel through the conduit 410*i* and eventually exits the cartridge 400. In one embodiment, when the sample 425*i* travels through the discontinuity 412*i* at least a portion of the sample enters the analyte processing device input 443*i* in the mounting surface 442. Alternatively, or in addition, when the sample 425*i* travels through the discontinuity 412*i* at least a portion of the sample enters the analyte processing device input 444*i* in the mounting surface 442. The processing device 450 is disposed on the mounting surface 442, as described above. The sample 425*i* that enters the analyte processing device inputs 443*i*, 444*i* contacts the processing device 450. More specifically, the sample 425*i* that enters the analyte processing device inputs 443*i*, 444*i* contacts the membrane 455*i* on the processing device 450. Once the sample 425*i* contacts the processing device 450 membrane 455*i*, the processing device 450 can process the information about that sample 425*i*. Other membranes 455 (e.g., 455*a*-455*h*) on the processing device 450 are likewise put in contact the sample 425 (e.g., 425*a*-425*h*) via the processing device inputs 443, 444 (e.g., 443*a*-444*h* and 444*a*-444*h*).

Referring now to FIGS. 1, 2, and 4A-4H, the sample 425 binds to a plurality of magnetic particles (e.g., a plurality of magnetic beads) to form an analyte-particle complex. In one embodiment, the sample 425 is mixed with the magnetic particle in the sample reservoir 415. In another embodiment, the magnetic particle is contained in the fluid 150, for example, in the fluid input 120. In another embodiment, the magnetic particle is contained in the sample specimen 420 and enters the conduit 410 via the cartridge input 401 and/or the sample input 411.

The analyte-particle complex is localized onto a surface of the processing device 450, for example, the membrane 455 (e.g., 455*a*-455*i*) by applying a gradient magnetic field. The magnetic field induces a polarization in the magnetic material of the particle that is aligned with the local magnetic field lines. The particle experiences a net force in the direction of the gradient, causing the particle to migrate toward regions of higher field strength. The magnetic field distribution is tailored to draw analyte-particle complexes from the sample flow and distribute them across the membrane 455 of the processing device 450. Extraneous background components of the sample (e.g., cells, proteins) generally have a much lower magnetic susceptibility as compared to the magnetic particles, and so the magnetic field does not significantly influence them. As a result, only a very small fraction of this background material interacts with the sensor surface.

Where the processing device 450 is a flexural plate wave (FPW) device the FPW device functions particularly well with the magnetic particles for two reasons. First, the presence of the magnetic particles on membrane 455 of the processing device 450 results in an amplified FPW signal response. The larger combined size and density of the analyte-particle complex yields a larger FPW signal response than the sample 425 alone. Second, the membrane 455 of the sensor in the FPW device is a thin membrane that is typically only a few micrometers thick, which allows larger magnetic fields and field gradients to be created at the membrane surface 455, because the field source can be positioned closer to the sample 425 flow. This results in higher fractional capture of the sample 425. With this higher capture rate and efficiency, it is possible to process larger sample volumes in shorter times than would be otherwise possible. The processing device 450 can include a monitoring device that monitors at least one signal output by the flexural plate wave device.

In one embodiment, the sample 425 is not bound to magnetic particles. For example, in an embodiment where the FPW device has a level of sensitivity that avoids the need for amplification of the FPW signal. In another embodiment, the sample 425 that is being evaluated is of adequate size that amplification of the sample is unnecessary to enable FPW signal detection. In such embodiments, the sample 435 is not bound to magnetic particles.

In one embodiment, the cartridge 400 is designed to cause the sample 425 to flow through the cartridge 400 such that it passes close to (and/or contacts) the membrane 455 of the processing device 450. The magnetic particles may be initially located in one or more of the sample specimen 420, in the sample reservoir 415, the fluid 150, the fluid input 120, and in the cartridge input 401. In one embodiment, the fluid 150 contains magnetic particles that mix with the sample specimen 420 in the conduit 410 of the cartridge. The magnetic particles may be combined with the sample specimen 420 and/or the sample 425 by a device (e.g., by the action of a pump or a magnetic agitator). Further, in some embodiments, one or more sources of magnetic flux are part of the cartridge.

In one embodiment, the processing device 450 is an FPW device, which is shown in more detail in FIG. 4I. In the FPW device 450, strain energy is carried in bending and tension in the device. In some embodiments, it is desirable for the thickness-to-wavelength ratio of the FPW device 450 to be less than one, and in some cases much less than one. In general, the wavelength "λ" of the FPW device 450 is approximately equal to the pitch of the interdigitated electrodes 460 as described herein. In one embodiment, the thickness-to-wavelength ratio of the FPW device 450 is on the order of 2 μm/38 μm. In other embodiments, the FPW device 450 is designed to isolate a particular mode (e.g., any mode from the zeroth order mode to higher order modes) or bandwidth of modes associated with the device. For example, an FPW device 450 having a thickness/wavelength of 2 μm/38 μm as described above would isolate on the order of the $80^{th}$ mode of the FPW device 450. The FPW device 450 can be designed to achieve this effect by selecting a particular pattern for the interdigitated electrodes 460. In one embodiment, the FPW device 450 is rectangular in shape. The FPW device 450 can, alternatively, be circular or elliptical, or some other planar shape.

In general, the FPW device 450 is constructed from a silicon wafer 1300, using micro-fabrication techniques known in the art. In the described embodiment, a cavity 1320 is etched into the wafer 1300 to produce a thin, suspended membrane 455 that is approximately 1.6 mm long, from about 0.3 mm to about 0.5 mm wide, and from about 2 to about 3 μm thick. The overall wafer 1300 thickness is approximately 500 μm, so the depth of the cavity 1320 is just slightly less than the wafer 1300 thickness. A 0.5 μm layer 1360 of aluminum nitride (AlN) is deposited on the outer surface (i.e., the surface opposite the cavity 1320) of the membrane 455, as shown in FIG. 4J, in the expanded view insert of FIG. 4I. Two sets of inter-digitated metal electrodes 460 and contact pads 461 with connecting electrical traces are deposited upon the AlN layer. A thin layer 1400 of gold (approximately 1000 angstroms) is deposited on the inner surface (i.e., the surface facing the cavity 1320) of the membrane 455 to facilitate immobilization of capture agents (described in more detail below).

In operation, instrument/control electronics apply a time-varying electrical signal to at least one set of the inter-digitated metal electrodes to generate vibrations in the suspended membrane 455. The instrument/control electronics also monitor the vibrational characteristics of the membrane 455 by receiving a sensor signal from at least a second set of electrodes. When liquid is in contact with the cavity side 1320 of the membrane 455, the maximal response of the plate structure is around 15-25 MHz. The instrument/control electronics compare a reference signal to the sensor signal from the second set of electrodes to determine the changes in the relative magnitude and phase angle of the sensor signal as a function of frequency. The instrument/control electronics interpret these changes to detect the presence of the targeted analyte. In some embodiments, the instrument/control electronics also determines, for example, the concentration of the targeted analyte on the inner surface of the membrane 455.

Capture agents targeting the analyte of interest are immobilized on the thin layer of gold 1400 covering the inner surface of the membrane 455. In one embodiment, thiol-terminated alkyl chains are linked to the gold surface forming a self-assembled monolayer (SAM). A fraction of the SAM chains are terminated with reactive groups (e.g., carboxyl) to allow covalent linking of capture agents to the SAM chains using biochemical process steps known in the art. The remainder of the SAM chains are terminated with non-reactive groups, preferably ones that have a hydrophilic character to resist nonspecific binding (e.g., oligomers of ethylene glycol). In another embodiment, disulfides with biotinylated oligoethylene glycol chains (i.e., n of EG unit is typically 8~9) are linked to the gold surface via disulfide-gold interaction and form a monolayer. The oligoethylene glycol chains in this molecule provide a high-resistance toward non-specific binding of unwanted biological molecules. The terminal group of this monolayer (i.e., biotin) allows a biotin-binding protein (i.e., neutravidin) to be immobilized on them, and the resulting neutravidin layers serve to further link capture agents (i.e., antibodies).

In another embodiment, the sensing surface of the membrane 455 is functionalized with capture agent. Gold coated sensors are cleaned using an oxygen plasma source. Typical processing conditions are 50 W for 2 minutes. The FPW device 450 is subsequently incubated in ethanol for 30 minutes. Next, the FPW device 450 is transferred to a 0.5 mM solution of biotin PEG disulfide solution (Polypure, Cat No. 41151-0895) in ethanol and allowed to incubate overnight. The FPW device is transferred back into a pure ethanol solution for 30 minutes. The chips receive a brief, final ethanol rinse and are blown dry using a nitrogen stream. Variations on preparation conditions can be made with similar results achieved. The resultant biotinylated surface is coated with Neutravidin (Pierce PN 31000) by flowing a 10 ug/ml solution of neutravidin over the biotinylated surface for 1 hour. Antibody is biotinylated according to the manufacturer's instructions (Invitrogen/Molecular Probes PN F-6347) and then coupled to the neutravidinated surface, by flowing, for example, 5 ug/ml solution of the biotinylated antibody (diluted into 1×PBS 0.1% BSA buffer), over the neutravidin coated surface for 1 hour. Other surface chemistries are described in the literature and can be used to produce a capture surface.

The FPW device 450 is packaged to allow electrical connections to the intergiditated electrodes 460 on the outer surface of the membrane 455. The interdigitated electrodes 460 are electrically connected to contact pads 461 disposed around the periphery of surface 1360 of device 450. Additionally, the FPW device 450 is mechanically supported by conduit 410, to allow for the inner surface of the membrane 455 to contact the samples 425 and an interface (e.g., the mounting surface 442 and processing device inputs 443, 444) is provided for contacting the sensor surface 1430 with the sample 425.

The conduit 410 is a path through which the sample 425 flows past the inner surface of the membrane 455. In one embodiment, a seal 1440 is formed between the FPW device 450 and the conduit 410 to prevent analyte test solutions from escaping from the conduits 410 formed within cartridge 400 on which the FPW device 450 is disposed. In another embodiment, the conduit 410 is a fluid chamber and the FPW device 450 is at least in part one of the interior walls of the conduit 410. The delicate membranes 455 in the processing device 450 are fragile (e.g., glass-like) and disposal of the processing device 450 on the cartridge 400, formed of plastic, should be approached carefully to avoid stressing the fragile membranes 455. In addition, the tolerance differences of the materials employed in making the processing device 450 as compared to the cartridge body 404 should be considered during material selection in order to ensure cartridge 400 accuracy.

Figure 5A:
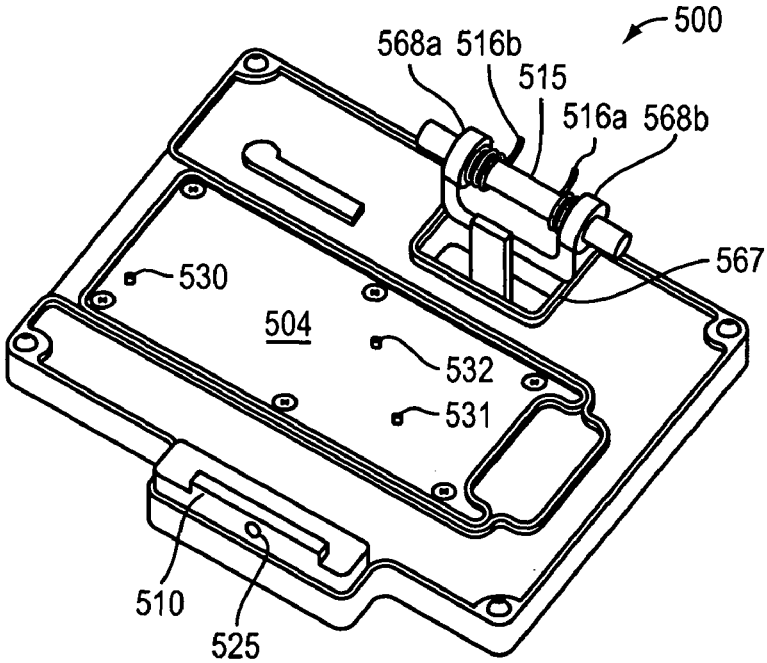
FIG. 5A is a top view of a plate.
Figure 5B:
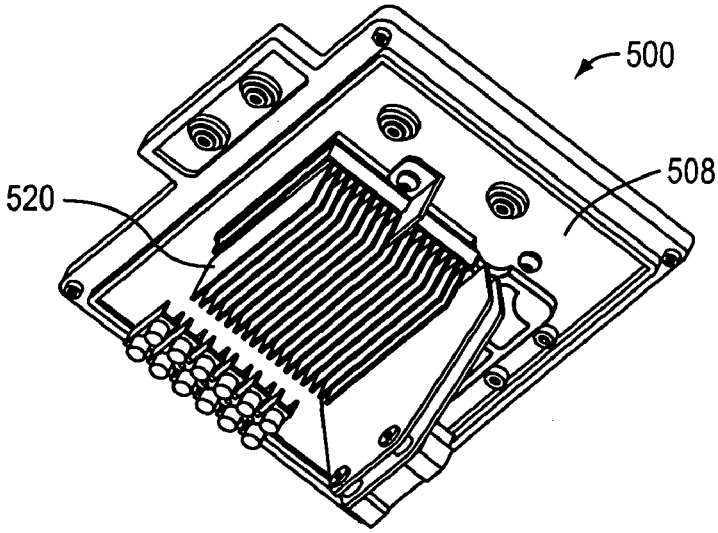
FIG. 5B is a bottom view of the plate of FIG. 5A depicting a heat sink.

As previously discussed, the cartridge 400 features a plurality of positioning members. Positioning members can include, for example, positioning apertures disposed on the cartridge 400 and/or pins disposed on the cartridge 400. In one embodiment, a positioning aperture mates with a positioning pin. For example, the cartridge 400 has one or more positioning apertures 431, 432, 433, 434. Positioning apertures (e.g., 431) are apertures within the cartridge 400 that mate with a positioning pin. Referring also to FIGS. 5A and 5B, mating positioning pins 531, 532 are, for example, disposed on the plate 500 and the positioning pins 531, 532 secure the cartridge 400 to the plate 500 in a desired position and prevent movement of the cartridge 400 on the plate 500.

Referring now to FIGS. 1, 4D, 4F, and 6A various electronic configurations can be used to achieve a desired processing device 450 frequency response. Alternatively, or in addition, electronic configurations can be used to achieve a desired number of contacts with the processing device 450. In some embodiments, it is desirable to electrically isolate each membrane (e.g., electrically isolate membrane 455*h* from membrane 455*i*) through a multiplexing chip. In some embodiments, it is desirable to group or tie some connections together (e.g., membranes 455 within the processing device 450 can be ganged).

In one embodiment, where the processing device 450 is a FPW device, the electronic configuration is a single set of drive and sense electronics that is multiplexed to each individual membrane 455*a*-455*i* (generally 455). Where the electronic configuration is a single set of drive and sense electronics that is multiplexed to each individual membrane 455, the device and its configuration can be referred to as bipolar (i.e., there is a set of electronics at the device input and output, that drives and senses the same differentially, and there is an independent ground through the substrate plane). Suitable multiplex chips that may be employed include, for example, MAX4565 (available from Maxim Integrated Products, Inc. Sunnyvale, Calif.), SW90-0004A (available from M/A-Com, Lowell, Mass.), ADG707 and ADG726 (available from Analog Devices, Norwood, Mass.).

In another embodiment, one of the input (i.e., common-drive) and the output (i.e., common-sense) are multiplexed. Where either the input or the output are multiplexed, there is no measurable cross-talk between the membranes 455*a*-455*i* (i.e., there less than 1% cross talk for either a multiplexed input or a multiplexed output). Where only the input (i.e., common-drive) is multiplexed there is a drop in frequency response magnitude of about 1 dB. Where only the output (i.e., common-sense) is multiplexed there is a drop in frequency response magnitude of about 6 dB. Thus, the drop in frequency response magnitude is greater where the output is multiplexed versus where the input is multiplexed.

Where one or more of the membranes 455 are ganged (e.g., the membranes 455*h* and 455*i* are tied or grouped together) the drop in frequency response magnitude drops in a manner proportionate to the number of ganged membranes 455. Both the drive (i.e., input) and the sense (i.e., output) signals can be ganged together so that when one membrane 455 is driven, so are the others, or when one membrane 455 is sensed, so are the others. In one embodiment, a FPW device is designed to have passbands that are separated in frequency. Where the passbands are sufficiently isolated (e.g., at sufficiently different frequencies) cross-talk between membranes (e.g., between membrane 455*h* and membrane 455*i*) is less than 1%.

In another embodiment, the input (i.e., drive) and/or the output (i.e., sense) of an FPW device is with a single electrode (rather than differentially) this is referred to as single ended drive/sense. For example, standard FPW devices are employed with one of the electrodes connected to ground. Where single-ended drive is used, the magnitude response drops by a magnitude of about 6 dB. In effect, the signal to the FPW device is effectively cut in half while the reference is left the same. When using single-ended sense, the background overwhelms the signal to such an extent that it is not possible to track any accumulation. Ganging one of the input (i.e., drive) and the output (i.e., sense) does not result in cross talk that would affect current measurements; however, ganging both input (i.e., drive) and output (i.e., sense) does result in cross talk that would affect current measurements.

Ganging can reduce the number of electrical connections to an array of devices, however, it results in a drop in the frequency response function magnitude. The desire for reduced connections is balanced with the desired signal to noise ratio for a given application. Where optimal signal to noise ratio is desired a bipolar (non-ganged) configuration is employed, however, the disadvantage is that more connections are required.

The various electronic configurations employed in the system 10 generally involve connecting the FPW 450 to the circuit with complementary electrical contact points 660 disposed on the surface of the socket 630. In one embodiment, the complementary electrical contact point 660 is the a spring pogo socket assembly available from Aries Electronics (Frenchtown, N.J.). Each FPW electrode contacts an complementary electrical contact point 660 that features a spring-loaded pin with a pointed tip. The pointed tip is able to contact the surface. For example, the pointed tip can penetrate through debris on the surface of the chip at the contact pads 461. The spring-loaded pin is mounted in a socket that is screwed to a printed circuit board. The printed circuit board has gold coated pads that contact the spring side of the pogo. Other pogo pins connect chip, ground, RTD traces, and other electrical features. Alternative methods for contact of the complementary electrical contact point 660 include, for example, wire-bonding to a flex cable, a rubberized polymer embedded with gold threads referred to as Z-Strip, and other sockets available from Gryphics (Plymouth, Minn.) and Johnstech International (Minneapolis, Minn.).

Where the contact between the complementary electrical points 660 and the FPW device 450 is poor the result is similar to the result of single ended drive or singled ended sense, there is a magnitude response drop and/or a presence of background that overwhelms the signal to such an extent that it is not possible to track accumulation. Where a drive pin is not contacted, the magnitude response drops slightly and the background rises slightly. This is often not obvious and can still provide reliable data. However, if a sense pin is not contacted, the background rises enough to make the sensor unusable.

One cause of poor contact is dirty contact pads 461 on the FPW device 450. This can arise from natural oxidation or insufficient cleaning of any surface chemistry to which the FPW device is exposed. The oxidation can be cleaned by suitable methods including, for example, plasma ashing. Where surface chemistry remains on the contact pads 461 of the FPW device 450, cleaning the surface chemistry involves exposing the FPW device 450 to ethanol by, for example, rubbing a cotton swab or a Kimwipe® soaked in ethanol on the contact pads 461.

Due to the small signals at high frequencies, the type and distance of the connection between the FPW device 450 and the network analyzer circuit is important. In one embodiment, the socket 630 containing the complementary electrical contact points 660 is on the same Printed Circuit Board as the analyzer circuitry. In another embodiment, due to constraints including, for example, size and placement, the FPW device 450 is separated from the analyzer circuit.

In one embodiment, a 2 inch long header was employed at a 0.1 inch spacing. In another embodiment one or more of: flex cable, ribbon cable, HDMI cables, CAT5e network cable, and coaxial cable are employed to connect the FPW device and the network analyzer circuit. Because each membrane 455, any contact pads 461, and/or any material (e.g., electroding material) on the contact pad 461 on the FPW device 450 measures only a few picofarads, it is important to minimize any capacitive loading in the connection between the electrode device and the analyzer circuit. Capacitive loading introduces a background noise that increases with frequency and eventually overwhelms the signal. The acceptable distance between the membrane 455 and the network analyzer circuit depends on the type of connection used. Typically, the distance between the FPW device 450 membrane 455 and the network analyzer circuit is only a few inches. Where amplifiers are placed close to the FPW device 450 membranes 455 the distance (i.e., the signal length) can be extended. For example, in one embodiment, amplifiers were placed in close proximity to the membranes 455 of the FPW device and a coaxial cable measuring 6 feet long was employed to connect the FPW device 450 to the network analyzer circuit.

Referring now to FIGS. 1, 5A and 5B a plate 500 is disposed on a support surface such as, for example, a top surface of the housing 100. One side of the plate 500 features complementary locating member 510. In one embodiment, the complementary locating member 510 features a magnet. The other side of the plate 500 has a rotation axis 515 and, optionally, one or more torsion springs 516*a*, 516*b* are disposed about the rotation axis 515. The top surface 504 of the plate 500 features one or more positioning pins 531, 532. Referring also to FIGS. 4A-4H, the positioning pins 531, 532 mate with positioning apertures (e.g., 431, 432) on the cartridge 400. The plate 500 has one or more positioning pins 531, 532. Referring now to FIGS. 4A-4H, 5A, and 5B the cartridge 400 is secured on the plate 500 by inserting the positioning pin 531 into the positioning aperture 431 and inserting the positioning pin 532 into the positioning aperture 432. In one embodiment, a single positioning pin 531 disposed on the base 500 mates with a single positioning aperture 431 disposed on the cartridge 400. In one embodiment, a single positioning pin 532 disposed on the plate 500 mates with a single complementary positioning aperture 432 disposed on the cartridge 400. In one embodiment, the top surface 504 of the plate 500 has a substantially flat surface that interfaces with the sealing layer 408 of the cartridge 400. Referring now to FIG. 5B, the bottom surface 508 of the plate 500 has a temperature control device 520 such as, for example, a Peltier device connected to a heat sink that controls the temperature of the thermal plate 530. The bottom surface 508 of the plate 500 can have a thermoelectric device (e.g., Melcor PolarTEC, PT4-12-30 available from Melcor in Trenton, N.J.) and/or a heat absorber (e.g., Melcor HX8-101-L-M available from Melcor in Trenton, N.J.), for example. The thermoelectric device is controlled using, for example, a circuit chip such as an interdigitated circuit chip supplied by MAXIM (e.g., MAX1978 available from Maxim Integrated Products, Inc. Sunnyvale, Calif.). In one embodiment, referring now to FIGS. 4A-4H, 5A, and 5B, the temperature control device 520 controls the temperature of, for example, the sample specimen 420 (e.g., the sample specimen 420 located in the one or more specimen reservoirs 415*a*-415*i*). In another embodiment, the temperature control device 520 controls the temperature of the sample 425 in one or more of the conduits 410*a*-410*i*. In still another embodiment, the temperature control device 520 controls the temperature of the fluid 150 in one or more of the conduits 410*a*-410*i*. The temperature control device 520 can control the temperature of multiple flows and flow sources. The temperature of the flows through the conduits 410 within the cartridge 400 determine the behavior of the fluid flow therethrough. In one embodiment, the temperature control device 520 controls the temperature of the sample 425 flowing through the conduits 410 in the cartridge 400 to provide the desired temperature at the point where the sample 425 contacts the FPW 450, for example, at the membrane 455. In one embodiment, the cartridge 400 has a thin wall disposed between the surface of the plate 500 and the sample 425 that flows through the conduits 410. The thin wall can be, for example, a sealing layer that is hydrophilic. Portions of the cartridge 400 are selected and/or designed to enable thermal conduction into the conduits 410. Design features of the cartridge 400 that enable thermal control include, for example, the thickness of the material in one or more areas, the type of material (e.g., non-insulative plastics), and the surface area of the portion of the cartridge 400 that contacts that plate 500. The temperature of the sample 425 is important to ensure that the processing device 450 provides accurate information. For example, to the extent that a FPW is an acoustic sensor the temperature of the sample 425 in the conduits 410 should be provided to ensure accurate processing of the analyte information. The temperature of the analyte (e.g., the sample) can have a value within the range of from about 15° C. to about 37° C., from about 25° C. to about 32° C., or about 20° C.

The sealing layer 408 on the cartridge 400 allows for fluid thermal conditioning of, for example, wash buffers, the fluid 150, the sample specimen 420 and/or the sample 425, prior to and/or during processing by the processing device 450. When the sealing layer 408 contacts a thermally controlled surface (e.g., the top surface 504 of the temperature controlled plate 500) the liquid flowing through the cartridge 400 is thermally conditioned. Thermal conditioning of liquids (e.g., wash buffers, the fluid 150, the sample specimen 420 and/or the sample 425) impacts and/or controls the viscosity, density, and/or speed of sound of the liquid flowing through the cartridge 400. The speed of sound of the liquid flowing through the cartridge 400 strongly influences the FPW processing device, because the FPW processing device strongly interacts with the acoustic properties of liquids.

The plate 500 can be made from any of a variety of materials including, for example, polymers, copolymers, metal, glass, and combinations and composites of these. In one embodiment, plate 500, including the top surface 504 and the positioning pins 531, 532, is a formed aluminum plate. Optionally the formed aluminum plate 500 is anodized to improve its ruggedness (e.g., corrosion and abrasion resistance).

Figure 6A:
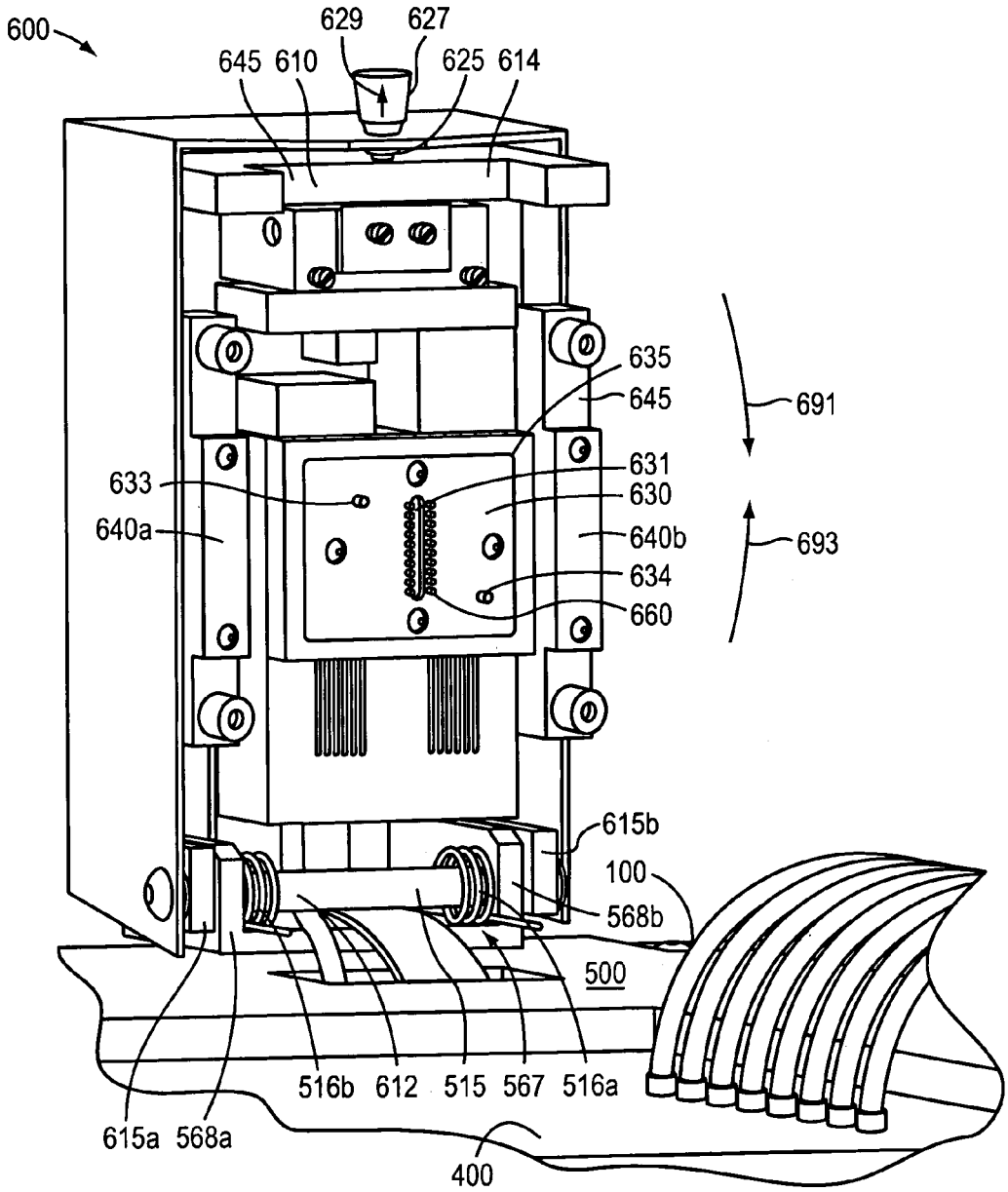
FIG. 6A is a view of a cover, a frame, an inner frame, and a socket with the cover rotating about a rotation axis.
Figure 6B:
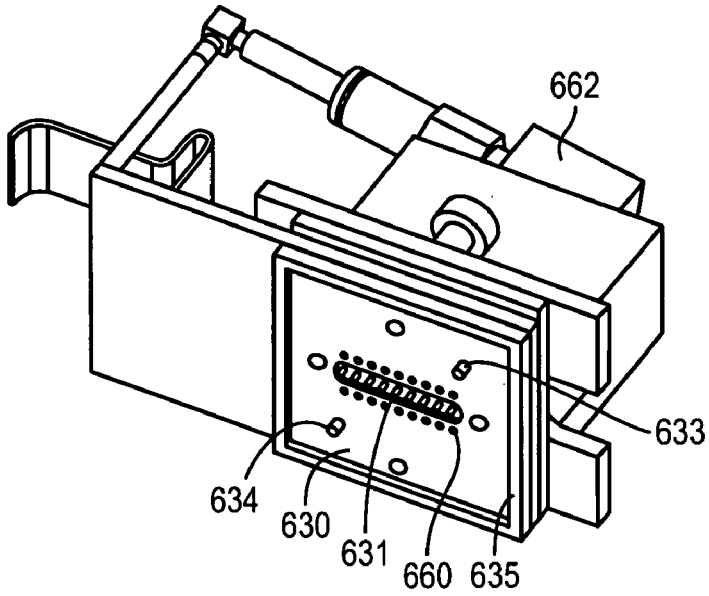
FIG. 6B is a view of a socket and a pneumatic valve.
Figure 6C:
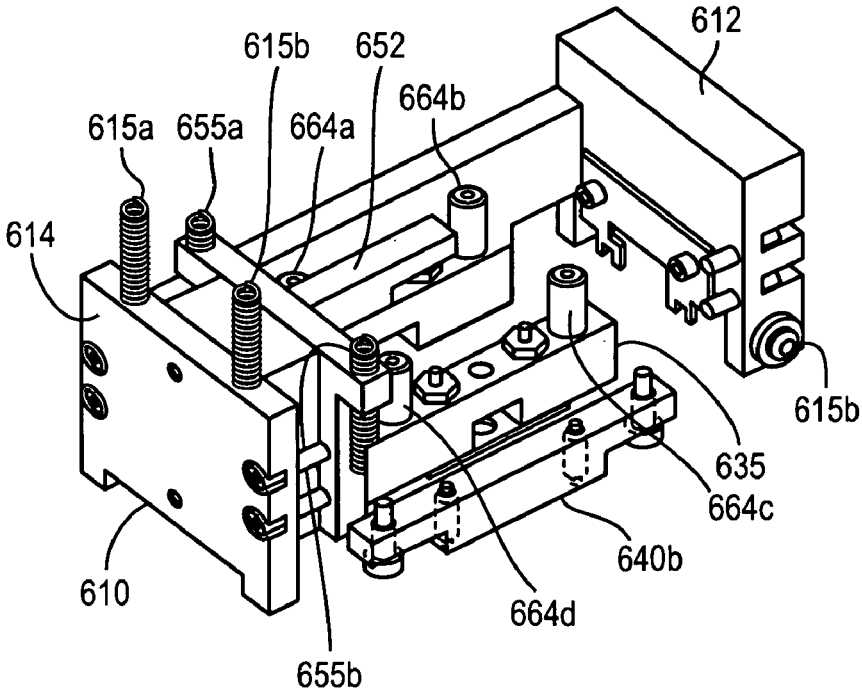
FIG. 6C is a view of a carriage that is housed within a cover such as the cover shown in FIG. 6A.
Figure 6D:
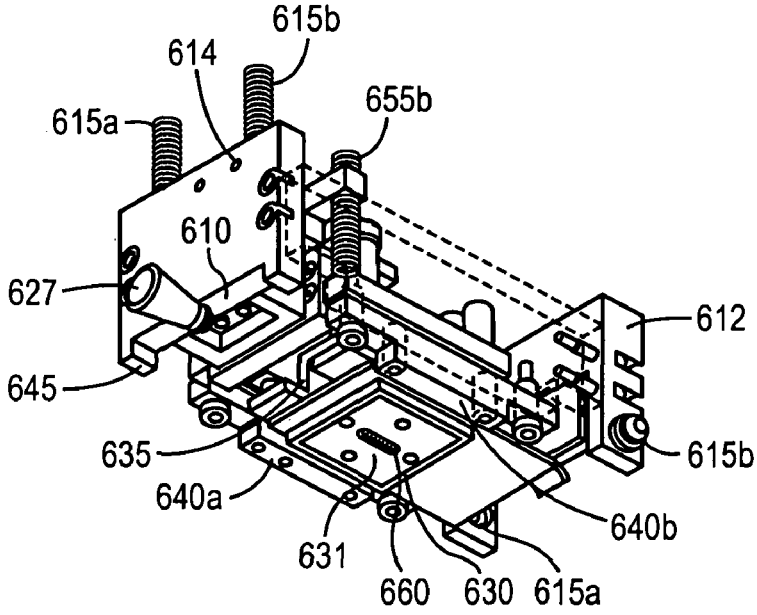
FIG. 6D is a view of a frame, an inner frame, and a socket.
Figure 6E:
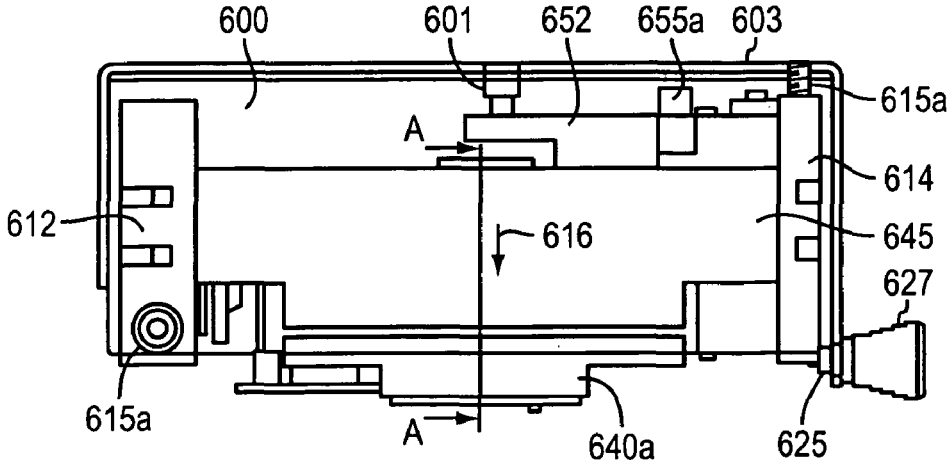
FIG. 6E is a side view of a cover positioned relative to a frame having a lock.

FIGS. 1, 6A, and 6E depict a cover 600 that covers at least a portion of the cartridge 400. The cover 600 encloses a frame 645. The frame 645 has a first foot 640*a*, an adjacent second foot 640*b*, a first end 612 substantially perpendicular to the first foot 640*a*, and a second end 614 substantially parallel to and spaced from the first end 612. The second end 614 is, in one embodiment, substantially perpendicular to the first foot 640*a*. In one embodiment, the first end 612 includes a rotation axis 515 and the second end 614 has a locating member 610. A socket 630 is disposed in the frame 645. In one embodiment, the socket 630 is disposed within an inner frame 635 that is surrounded by the frame 645. The socket 630 has a plurality of complementary electrical contact points 660 disposed on the surface of the socket 630, for example, aligned with electrical contact pads 461 on a processing device 450. Inner frame 635 houses a plurality of magnets. The rotation axis 515 extends through at least a portion of the housing 100 and the cover 600 rotates about the rotation axis 515. When the cover 600 is moved in direction 691, the first foot 640*a* and the second foot 640*b* contact the top surface 405 of the cartridge 400 disposed on thermal plate 504. (See, e.g., 5A, and 4A-4I). In one embodiment, the rotation axis 515 is disposed on the top surface of the housing 100. The cover 600 and/or the socket 630 are moved in a position substantially parallel to the top surface of the housing 100. In one embodiment, the point 625 of the lock handle 627 releasably secures the cover 600 to a gap 525 in a complementary locating member 510. (see, also FIG. 5A). In one embodiment, referring also to FIG. 6E, once the socket 630 is disposed in a position substantially parallel to the top surface of the housing 100 the socket 630 moves in a substantially vertical direction 616 toward the processing device 450 disposed on the top surface of the housing 100. The plurality of electrical contact points 660 contact the plurality of electrical contact pads 461 on the processing device 450. The plurality of magnets 631 disposed in the inner housing 635 actuate to align with the processing device 450 that is disposed on the cartridge 400. In one embodiment, the positioning pins (e.g., 633, 634) and the complementary positioning apertures (e.g., 433, 434) mate to ensure proper placement of the socket 630 relative to the cartridge 400 and the processing device 450.

Referring also to FIGS. 4A to 4B, in one embodiment, when the cover 600 is secured to the plate 500, the plurality of electrical contact points 660 contact the plurality of electrical contact pads 461 and the plurality of magnets 631 actuate to align with the processing device 450 on the cartridge 400. Positioning pin 633 aligns with and fits inside positioning aperture 433, likewise, positioning pin 634 aligns with and fits inside a positioning aperture 434 defined by the cartridge 400 (see, FIGS. 4A-4B). In one embodiment, the positioning pins (e.g., 633, 634) and the complementary positioning apertures (e.g., 433, 434) mate to ensure proper placement of the cover 600 relative to the cartridge 400 and the processing device 450.

Referring again to FIG. 6A, in one embodiment, the cover 600 includes a lock handle 627 that has a point 625, a socket 630, a locating member 610, and electrical contact points 660. The cover 600 is disposed on the rotation axis 515 and can pivot about at least a portion of the rotation axis 515. Torsion springs 516*a*, 516*b* counterbalance the cover 600. Attachment member 567 limits motion of the cover 600 in direction 693.

FIG. 6D depicts the frame 645, the inner frame 635, and the electrical contact points 660 that are provided on at least a portion of the socket 630. Referring also to FIG. 6B, a pneumatic actuator 662 connects with and pushes one or more magnets 631 forward. In one embodiment, the pneumatic actuator 662 pushes the one or more magnets 631 forward so that they are just nearly flush with the surface of the socket 630. In one embodiment, referring to FIGS. 4B and 6D, there is one magnet 631 for each conduit 410 within the cartridge 400. In another embodiment, referring also to FIG. 1, there is one magnet 631 for each channel 110 in the system 10. In one embodiment, there are nine magnets 631 aligned along a row. Each magnet 631 is positioned to align with a conduit 410 and/or a sample 425 in the conduit 410. In one embodiment, the pneumatic actuator 662 actuates the plurality of magnets 631 to align to the surface of the socket 630 and/or with the processing device 450. In another embodiment, there are more magnets than conduits, which improves the magnetic field gradient.

Referring also to FIGS. 4I and 4J, the plurality of magnets 631 actuate to align with the processing device 450. The plurality of magnets 631 are centered substantially over the sensor surface 1430 of the processing device 450. The plurality of magnets 631 attract, for example, the plurality of magnetic particles to which the sample 425 binds. One or more of the plurality of magnets 631 are brought within from about 0.001 inches to about 0.020 inches, or from about 0.003 inches to about 0.010 inches from the sensor surface 1430 of the processing device 450 (in the Z direction, e.g., the direction normal to sensor surface 1430). In one embodiment, one or more of the plurality of magnets are brought within from about 0.001 inch to about 0.010 inches, or about 0.005 inches from the center of the sensor surface 1430 of the processing device 450 and between about 0.001 inch to about 0.010 inch from the center between the first portion of the conduit 413 and the second portion of the conduit 414 (see, FIG. 4F). Alternatively, or in addition, one or more of the plurality of magnets actuate to align with the processing device 450 in a direction parallel to the sensor surface 1430.

Referring now to FIGS. 5A, 5B, 6A, 6C, 6D, and 6E. In one embodiment, the rotation axis 515 secures the cover 600 to the plate 500. In one embodiment, an attachment member 567 is disposed on a plate 500 and the rotation axis 515 is a rod that is disposed within first end apertures 615*a*, 615*b* in the frame 645 within the cover 600 and in attachment member apertures 568*a*, 568*b* defined within the attachment member 567. Referring to FIGS. 1, 2, and 6A, when the cover 600 is moved in direction 691 the cover 600 pivots about the rotation axis 515. The cover's 600 first foot 640*a* and second foot 640*b* contact the cartridge 400. The cartridge 400 is disposed on a plate 500 and the plate 500 is located on the top surface of the housing 100.

Referring to FIGS. 6A, 6D, and 6E, when the cover 600 is moved in the direction 691 the shell portion 603 of the cover 600 is positioned relative to the frame 645. In particular, the shell portion 603 of the cover 600 is positioned relative to the second end 614 portion of the frame 645. One or more placement spring(s) 615*a*, 615*b* position the cover 600 relative to the frame 645. Placement springs 615 (e.g., 615*a* and 615*b*) are disposed on the second end 614 portion of the frame 645. When the shell portion 603 of the cover 600 is not substantially parallel with the top of the housing 100, the placement springs 615 are at least partially expanded. Moving the cover 600 in the direction 691 to the point at which locating member 610 comes into contact with complementary locating member 510 will cause the frame 645 to be substantially horizontal. Moving the cover 600 in the direction 691 past the point at which locating member 610 comes into contact with complementary locating member 510 shifts the placement of the shell portion 603 of the cover 600 relative to the frame 645 and compresses the placement springs 615. The spring force exerted by springs 615 holds locating member 610 in contact with complementary locating member 510, keeping the frame 645 substantially horizontal. Further, motion of the shell portion 603 of the cover 600 positions the point 625 of the lock handle 627 over a gap 525 in the complimentary locating member 510, thereby allowing the point 625 of locking member 627 to be secured in the gap 525. Thus, the cover 600 is releasably secured over the cartridge 400.

The shell portion 603 features a pin 601. In one embodiment, the pin 601 is disposed within the inside surface of the shell portion 603. In another embodiment, one or more pins 601 are disposed through the shell portion 603. Once the cover 600 is moved in the direction 691 past the point at which locating member 610 comes into contact with complementary locating member 510, thereby substantially compressing the placement springs 615, the pin 601 aligns with a carriage 652. In one embodiment, after the pin 601 aligns with the carriage 652, the shell portion 603 of the cover 600 forces the pin 601 into the carriage 652 and pushes the carriage 652 in the direction 616. The direction 616 is substantially vertical and is substantially perpendicular to the surface of the housing 100. Being perpendicular is important, for example, for positioning pins 633 and 634, into complementary apertures disposed in cartridge 400. Referring also to FIG. 6C, the carriage 652 has carriage springs 655*a*, 655*b* that are perpendicular to the cover 600 and approximately parallel to the pin 601. The weight and force applied to the shell 603 pushes the pin 601 into the carriage 652 and at least a portion of the carriage springs 655*a*, 655*b* within the carriage 652 are substantially compressed. The motion of carriage 652 in direction 616 acts to compress springs 664*a*, 664*b*, 664*c*, and 664*d*, disposed on carriage 652, against an upper horizontal surface of inner frame 635, thus applying a downward force on socket 630. This force compresses the electrical contact points 660 (e.g., spring-loaded) disposed on the socket 630 against the electrical contact pads 461 on the surface 1360 of the processing device 450. (See, e.g., FIGS. 4D-4I). In order to prevent the socket 630 from directly contacting and potentially damaging the processing device 450, various means of offsetting may be employed to offset the socket 630 from the processing device 450. Suitable means to offset the processing device 450 from the socket 630 include providing raised features on the cartridge 400 (e.g., raised surface 409.)

Referring still to FIG. 6C, the springs 664*a*, 664*b*, 664*c*, and 664*d* are disposed on carriage 652 and partially compressed against an upper horizontal surface of inner frame 635, thus enabling the inner frame 635 to pivot at any of a number of angles thereby enabling the socket 630 held within the inner frame 635 to likewise pivot. The pivoting action of the socket 630 enables the positioning pins 633, 634 to align with complementary positioning apertures disposed in the cartridge 400. Referring also to FIGS. 1, 4B and 6B, the socket 630 is aligned with the cartridge 400, the positioning pins 633, 634 on, for example, a surface of the socket 630 pivot together with the socket 630 until they are disposed in the complementary positioning apertures 433, 434 to ensure proper placement and alignment of the socket 630 relative to the cartridge 400 and the processing device 450 that is disposed relative to the cartridge 400. A plurality of complementary electrical contact points 660 are disposed on, for example, the surface of the socket 630. The plurality of electrical contact points 660 contact the plurality of electrical contact pads 461 and the plurality of magnets 631 actuate to align with the processing device 450 on the cartridge 400. In one embodiment, the plurality of magnets 631 actuate upon activation of the pneumatic actuator 662, which pushes the one or more magnets 631 forward so that they come in close proximity to the processing device 450. In one embodiment, the surface of one or more magnets 631 is within 200 μm of the processing device 450. In certain instances, one or more of the plurality of magnets 631 is allowed to contact the processing device 450, more specifically, one or more of the plurality of magnets is allowed to contact the electrode cover 448 disposed on the processing device 450.

In one embodiment, the locating member 610, the complementary locating member 510, and/or the lock 627 secure the cover 600 and/or the surface of the socket 630 in a position substantially parallel with the top of the housing 100. The cover 600 includes one or more locks 627. In one embodiment, referring to FIG. 6E, the lock 627 has a point 625 at one end and a handle at the other end. Referring now to FIGS. 1, 2, and 6A, when the cover 600 is moved in direction 691 the cover 600 pivots about the rotation axis 515, the first foot and second foot 640*a*, 640*b* contact the cartridge 400, the locating member 610 contacts the complementary locating member 510 and the point 625 of the lock 627 enters a gap 525 defined by the complementary locating member 510. The electrical contact points 660 of socket 630 contact the processing device 450. When the point 625 is secured in the gap 525 the cover 600 is releasably secured over the cartridge 400. In one embodiment, the lock 627 is pulled in direction 629 to enable the point 625 to enter the gap 525. (see, FIG. 2).

In one embodiment, referring to FIGS. 1-2 and 6A, the cover 600 is released from the cartridge 400 by pulling the lock 627 in direction 629 thereby releasing the point 625 from the gap 525 defined by the complementary locating member 510. The cover 600 moves in direction 693 and is no longer substantially parallel with the top surface of the housing 100. In one embodiment, attachment member 567 limits movement of the cover 600 in direction 693. In another embodiment, the lock 627 is pulled in direction 629 thereby releasing the cover 600 from the plate 500 and the cover 600 moves in direction 693 to be substantially perpendicular to the top surface of the housing 100 (see FIGS. 1, 2, and 6A).

Figure 6F:
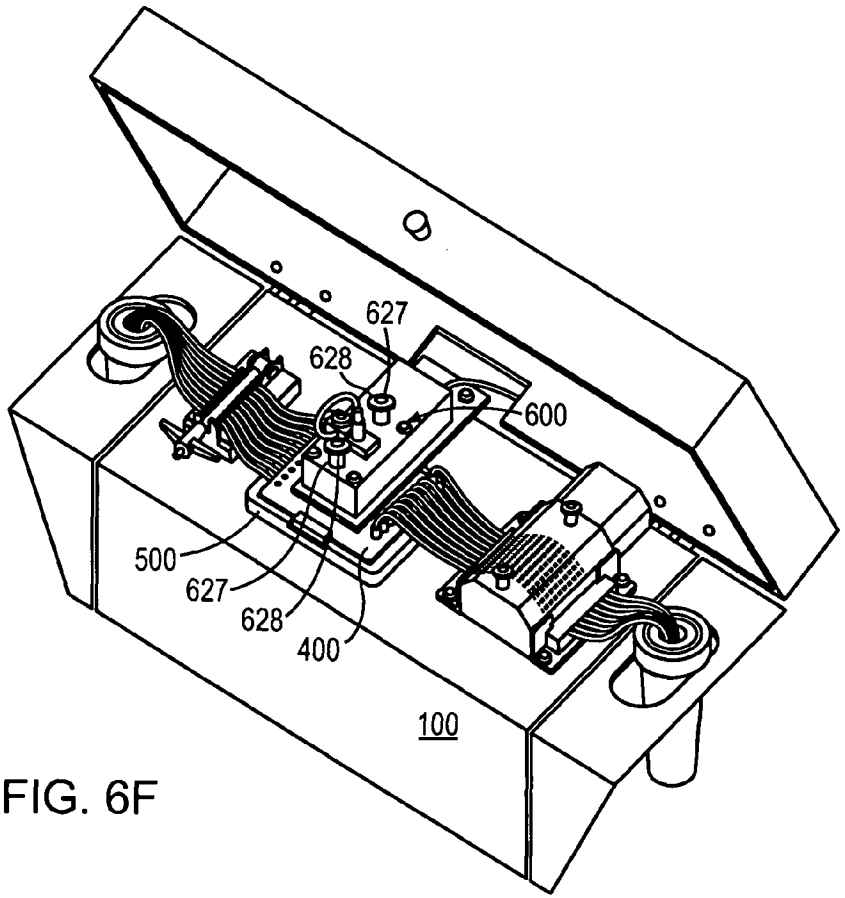
FIG. 6F is a top view of another embodiment of a system for processing an analyte sample, the system has a cover with a lock including a plurality of screws.

Alternative locks 627 may be employed to releasably secure the cover 600 over the cartridge 400. For example, referring also to FIGS. 6F and 6G, a cover 600 includes a frame and a socket is disposed within the frame. Electrical connections are disposed on the socket and a plurality of magnets are disposed in the inner frame 635. The cover 600 is pushed such that the cover 600 and/or the socket are substantially parallel with the top surface of the housing 100. In one embodiment, a cartridge 400 is disposed on the top surface of the housing 100. The cover 600 is releasably secured over the cartridge 400 by a lock 627. Referring now to FIG. 6F, the lock 627 can include one or more screws 628 disposed on and through the cover 600. The one or more screws 628 are mated with a complementary opening (e.g., an aperture sized to mate with the threaded end of the screw 628, a bolt sized to mate with the threaded end of the screw 628, for example) defined by the cartridge 400, and/or the plate 500, and/or the housing 100. The cover 600 is released from the cartridge 400 by turning the screw 628 in a direction opposite the threads to release the screws 628 from the complementary opening. In one embodiment, the cover 600 and/or the socket disposed therein rotate about an axis such that the cover 600 is no longer substantially parallel with the top surface of the housing 100. In another embodiment, the cover moves in a substantially vertical direction away from the top surface of the housing 100 such that there is no electrical connection between the cover 600 and/or the socket and the processing device and, in addition, the plurality of magnets are moved to a distance such that they cannot impinge on the processing device.

Figure 6G:
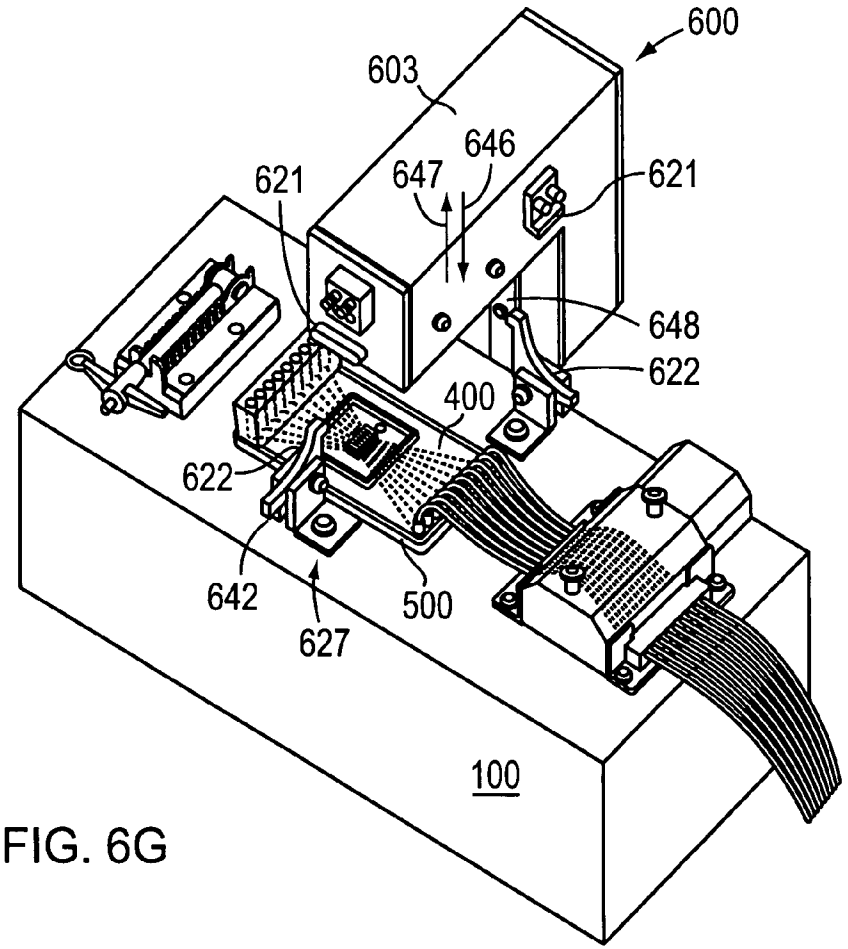
FIG. 6G is a top view of another embodiment of a system for processing an analyte sample, the system has a cover and a gantry that enables the cover to move toward and away from a cartridge.

In another embodiment, referring now to FIG. 6G, the lock 627 includes a hook 622 and a ledge 621. In one embodiment, the lock 627 includes one or more hooks 622 and one or more complementary ledges 621. When the cover 600 is moved (e.g., pushed) in direction 646 the one or more ledges 621 disposed on the shell 603 of the cover 600 move beyond the hooks 622. The hook 622 grasps the ledge 621 thereby releasably securing the cover 600 and the socket disposed therein in a position substantially parallel to the cartridge 400. In each embodiment, the secured lock 627 maintains the cover 600 in a position proximal to the cartridge 400 such that electrical contact points on the socket can contact the electrical contact pads on the processing device and the plurality of magnets disposed in the socket can align with the processing device.

Referring still to FIG. 6G the cover 600 can be disposed on a gantry 648 that enables the cover 600 to move toward the cartridge 400 in direction 646 or away from the cartridge 400 in direction 647. In such an embodiment, the cover 600 is pushed or pulled such that the cover 600 travels along the gantry 648 in direction 646. One or more ledge 621 disposed on the exterior of the cover 600 move past one or more hooks 622 disposed on the housing 100. The hook 622 grasps the ledge 621 thereby stabilizing the cover 600 such that it is proximal to the cartridge 400 disposed on the housing 100. In one embodiment, the lock 627 is released by pushing the end 642 of each hook 622 thereby releasing the hook from the ledge 621. Once each lock 627 is released, the cover 600 moves in direction 647 away from the cartridge 400.

Referring now to FIGS. 4A, 4B, 5A, 5B, 6B and 6D, in one embodiment, a method for aligning the cartridge 400 includes providing a processing device 450 disposed on a body 404. The body 404 has a surface (e.g., 405, 406) bounded by at least one edge 407. The surface defines a plurality of positioning members. A plate 500 has a plurality of positioning members. The method includes providing one or more of the plurality of positioning members in contact with a plurality of complementary positioning members defined by the plate 500. In one embodiment, the plurality of complementary positioning members are positioning pins 531, 532 and the plurality of positioning members on the cartridge 400 are positioning apertures 431, 432 that contact the plurality of positioning pins 531, 532. The positioning pins 531, 532 are placed inside the positioning apertures 431, 432 when the cartridge 400 is disposed on the plate 500. In one embodiment, one or more of the plurality of positioning members on the cartridge 400 are in contact with a plurality of complementary positioning members defined by the surface of the socket 630. In one embodiment, the socket 630 has a plurality of positioning pins 633, 634 that mate with the complementary positioning apertures 433, 434 to ensure proper placement of the socket 630 relative to the cartridge 400 and the processing device 450.

Referring now to FIGS. 7A-7D one or more grips 774, 775 can be employed to hold a portion of a channel 110. For example, in one embodiment, a portion of the output tubes 710*a*-710*i* are held by a first grip 774 and another portion of the output tubes 710*a*-710*i* are held by a second grip 775. The grip 774 has at least one groove 708 adjacent one or more teeth 706, likewise, the grip 775 has at least one groove 714 adjacent one or more teeth 712. In one embodiment, the grooves 710*a*-710*i* are defined in one side 7741 of the grip 774 and the grooves 714*a*-714*i* are defined in one side 7751 of the grip 775.

In one embodiment, a portion of a channel 110*a* is held by a groove 708*a* and another portion of the channel 110*a* is held by a groove 714*a*. For example, a portion of the output tube 710*a* is held by a groove 708*a* and another portion of the output tube 710*a* is held by a groove 714*a*. Likewise, a portion of each of the output tubes 710*b*-710*i* is held by the grooves 708*b*-708*i* and another portion of each of the output tubes 710*b*-710*i* is held by the grooves 714*b*-714*i*. In one embodiment, the grooves (i.e., 708 and 714) are sized to hold the outer diameter of the output tubes without compressing the tubes thereby avoiding occlusion of the fluid flowing through the output tubes 710. The output tubes 710 have an outer diameter that ranges in size depending on, for example, the requirements of a particular assay. The outer diameter of the output tubes 710 have a value within a range that measures from about 0.05 inches to about 0.15 inches, from about 0.08 inches to about 0.11 inches, or about 0.09 inches. The outer diameter of the output tubes 710 can also have a value within a range that measures from about 0.088 inches to about 0.1 inches. The output tubes have an inner diameter, through which fluid can flow, that have a value within a range that measures from about 0.015 inches to about 0.06 inches, from about 0.020 inches to about 0.035 inches, or about 0.020 inches.

Optionally, a portion of one or more output tube 710 is held in the groove of a grip 774, 775 by, for example, an adhesive. In one embodiment, a segment of each output tube 710 is held between a first grip 774 and a second grip 775. The segment of the output tube 710 that is between the first grip 774 and the second grip 775 can be pulled to a desired level or amount of tension and secured to a portion of the system 10 (see, FIG. 1). In one embodiment, the first grip 774 and the second grip 775 each have one or more cavities 732, 734 for positioning the grips 774, 775 relative to a desired position on the housing 100.

Referring also to FIG. 3C, alternatively, or in addition, the grips can be sized and/or shaped to interlock with one or more arm disposed on, for example, the pump, the valve, the enclosure, and/or the housing. The grip can be sized and shaped such that portions of the grip curve about the arm 3110 and are held against the arm 3110 by an applied force, for example, by tension fit tubes (e.g., input tubes 210) that are disposed between two grips 374, 375 and are held against the arms 3110 by the force of the tension.

Referring now to FIGS. 1, 2, and 8A-8C, the system 10 includes a fluid control device, for example, a pump 800. The pump 800 can be a peristaltic pump, a linear peristaltic pump, a rotary pump, an electro-osmotic pump, or a diaphragm pump, for example. In some embodiments, the pump 800 is located downstream of the processing device 450 and the pump pulls material through the system 10. In one embodiment, the pump 800 has an input side 801 with a plurality of pump input grooves (e.g., 708) and an output side 802 with a plurality of pump output grooves (e.g., 714). A segment of the channel 110 is disposed between the pump input side 801 and the pump output side 802. For example, the segment of a channel 110 is disposed between a pump input groove (e.g., 708) and a pump output groove (e.g., 714). For example, a segment of channel 100*a* is disposed between the first pump input groove 708*a* and the first pump output groove 714*a*. In one embodiment, the second pump input groove 708*b* is disposed adjacent the first pump input groove 708*a*, likewise, the second pump output groove 714*b* is disposed adjacent the first pump output groove 714*a*. The pump 800 rotates about an axis 811 substantially perpendicular to the segment of the channel 110 disposed between the pump input side 801 and the pump output side 802.

The pump 800 pulls the sample 425 through the channel 110. The processing device 450 processes the sample 425 in the channel 110 (see, FIG. 1). The system 10 has a fluid output 140 for disposal of the sample 425. The processing device 450 is a sensor for sensing the sample 425 in the channel 110 and, optionally, the processing device 450 is a flexural plate wave device.

Figure 8B:
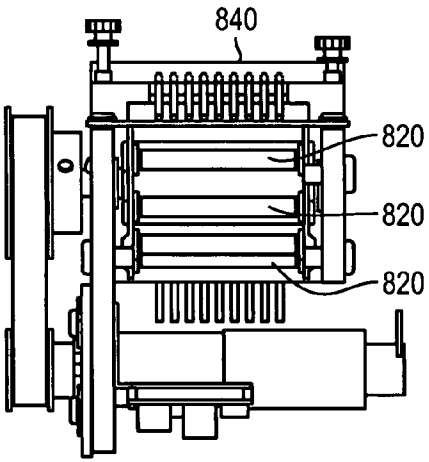
FIGS. 8A-8C show various views of a pump.
Figure 8C:
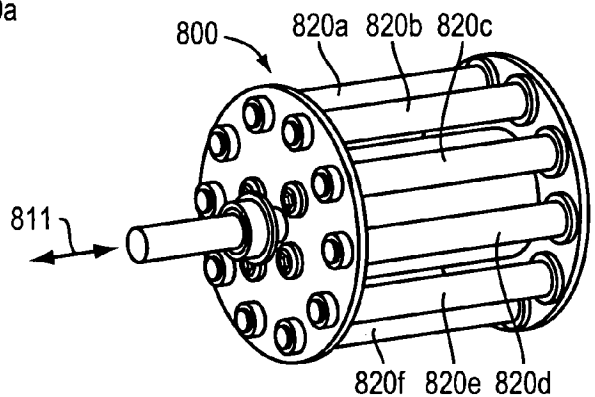
Figure 8A:
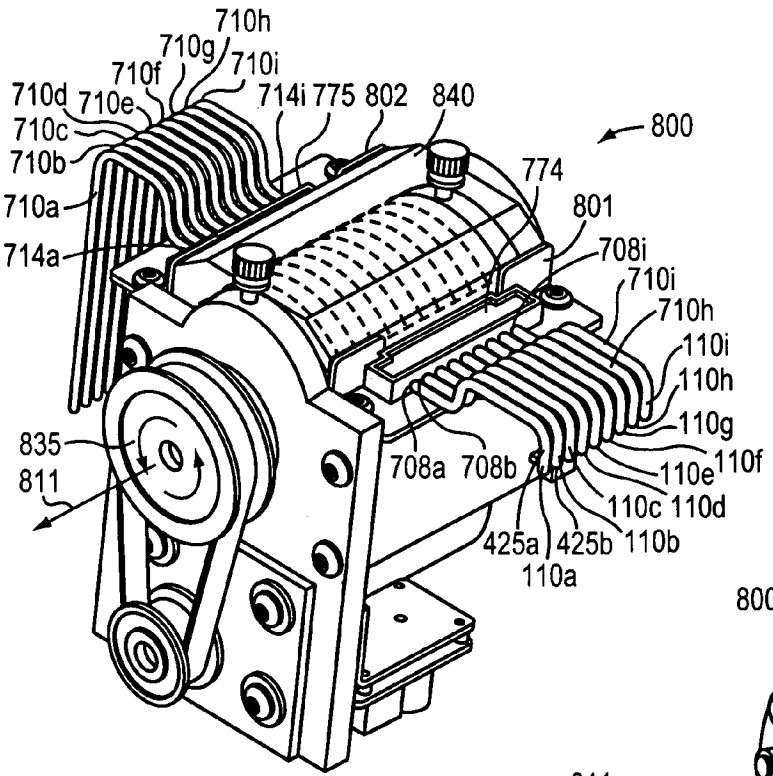

Referring still to FIGS. 8A-8C, the pump has a plurality of rollers 820 that rotate about the axis 811. The axis 811 is substantially perpendicular to the segment of the channel 100 disposed between the pump input side 801 and the pump output side 802. The plurality of rollers 820 rotate about axis 811 when the pump 800 rotates. For example, when the pump 800 rotates in direction 835 the plurality of rollers 820 rotate about axis 811 in direction 835. Alternatively, when the pump rotates opposite direction 835 the plurality of rollers 820 rotate in the direction opposite direction 835 about axis 811. The rollers 820 rotate about their own axis when they are in contact with the tubing 710, such rotation reduces friction on the tubing 710 during the pumping motion.

Referring also to FIG. 1, a portion of the pump 800 can be disposed in the housing 100. In one embodiment, a portion of the pump 800 is disposed above a surface of the housing 100, for example, the top surface of the housing 100. The amount of the pump that is exposed above the surface of the housing 100 can range from about 0.1 inch to about 1 inch, or from about 0.4 inches to about 0.8 inches, above the surface of the housing, for example. In another embodiment, from about 85 degrees to about 15 degrees, or about 65 degrees of the pump 800 is located above the surface of the housing 100. In one embodiment, a segment of the channel 110 (e.g., the segment of the channel 110 or the segment of the output tube 710 disposed between the pump input side 801 and the pump output side 802) is disposed between a cover 840 and the pump 800. The cover 840 can be a single piece. Alternatively, the cover 840 includes multiple pieces that are assembled together. The cover 840 and the rollers 820 can each be made from any of a variety of materials including, for example, polymers, copolymers, metal, glass, and combinations and composites of these.

In one embodiment, the cover 840 is fastened to the housing 100. In another embodiment, the cover 840 is fastened to the pump 800. The cover 840 can be fastened to the pump 800 and/or the housing 100 by any suitable fastener. In one embodiment, the cover 840 is fastened to the housing by one or more screws that mate with a complementary opening (e.g., an aperture sized to mate with the threaded end of the screw or a bolt sized to mate with the threaded end of the screw, for example) disposed on the pump 800 and/or the housing 100. In one embodiment, the pump 800 is a peristaltic pump and a segment of each channel 110 (e.g., the output tubes 710) is located adjacent the rollers 820 that compress the segment of the channels 110 (e.g., the output tubes 710). As the pump 800 rotates about the axis 811 the segment of each channel 110 (e.g., the segment of each output tube 710) disposed between the input side 801 and the output side 802 is compressed thereby forcing the sample 425 to be pumped (i.e., pulled) thorough the channel 110. The cover 840 is positioned and/or fastened in a manner relative to the rollers 820 on the pump 800 that enables the pump 800 to pull the sample 425 through each channel 110. Optionally, one or more shims may be employed between the cover 840 and the rollers 820 to ensure suitable compression that enables the pump 800 to pull sample 425 through the output tube 710 as required by the system 10. The number of rollers 820 can be a value within the range of from 6 to 18, of from 8 to 14, or 10. The rollers are sized to have a diameter with a value within the range of from about 0.02 inches to about 0.5 inches, from about 0.05 inches to about 0.375 inches, or about 0.1875 inches. The volumetric flow of the pump 800 has a value within the range of from about 1 microliter/minute to about 2,000 microliters/minute, from about 3 microliters/minute to about 1,000 microliters/minute, or from about 6 microliters/minute to about 500 microliters/minute. The pump 800 produces a coefficient of variation (CV) that is better than 5%. In one embodiment, the pump 800 has a CV that is better than 3%.

In one embodiment, the segment of the each of the channels 110 disposed between the input side 801 and the output side 802 of the pump 800 comprises a flexible tube. The input side of this flexible segment of each of the channels 110 disposed in the pump cover 840 is less than 3.3 inches downstream from the processing device 450 (e.g., the flexural plate wave device). (see, FIGS. 1 and 8A-8C).

In one embodiment, the pump 800 synchronously draws from the fluid input 120, e.g., a fluid reservoir, and the plurality of sample reservoirs 415 to provide a plurality of samples 425 through the plurality of channels 110. (see, FIG. 4B). In one embodiment, the pump 800 acts on the plurality of channels 110 individually generate synchronous flows. The pump 800 engages more than one channel 110 with a linear spacing of about 0.177 inches per channel (on centers).

In one embodiment, the pump input groove 708 and the pump output groove 714 tension fit a segment of each channel 110 over a surface of the pump 800. The surface can be, for example, the exterior surface of the rollers 820. A segment of one of the plurality of channels 110 (e.g., 110*a*) that contacts the plurality of rollers 820 has a contact area of less than 0.35 square inches. For example, a portion of the tube 710*a* is disposed in the first pump input groove (e.g., 708*a*) and another portion of the tube is disposed in the first pump output groove (e.g., 714*a*). A second pump input groove (e.g., 708*b*) is disposed adjacent the first pump input groove (e.g., 708*a*) and a second pump output groove (e.g., 714*b*) is disposed adjacent the first pump output groove (e.g., 714*a*). A portion of the second channel 110*b* comprises a second tube 710*b*, a portion of the second tube 710*b* is disposed in the second pump input groove (e.g., 708*b*) and another portion of the second tube 710*b* is disposed in the second pump output groove (e.g., 714*b*). The input grooves 708 and the output grooves 714 can be located in grips 774, 775 that hold a portion of the tubes 710 with, for example, adhesive.

In one embodiment, a grip 774 has a first pump groove (e.g., 708*a*) and a second pump groove (e.g., 708*b*). The first pump groove (e.g., 708*a*) holds a portion of a first tube 710*a* and the second pump groove (e.g., 708*b*) holds a portion of a second tube 710*b* and the tubing grip 774 interlocks with the housing 100. The pump 800 is disposed in the housing 100. The tubing grips can include, for example, grips 774, 775, that hold a segment of the tubes 710 over the surface of the pump 800 with tension. The tension imposed by the trips 774, 775 on the tubes 710 can be a value within the range of from about 1 lb to about 6 lbs, from about 2 lbs to about 5 lbs, or from about 3 lbs to about 4 lbs.

In another embodiment, the tension fit segments of the channels 110 (e.g., output tubes 710) are disposed over the pump 800 and at their highest point, the tension fit segments of the channels 110, are less than 0.4 inches above the plane of the supporting surface, for example, the housing. Thus, the distance in which the segments of the channels 110 bend over the pump 800 is impacted by, for example, the amount of the pump 800 that is above the plane of the supporting surface. Where the pump 800 exposure above the support surface is limited (e.g., where the pump has a low profile) the bending of the channels 110 is limited.

The pump 800 is capable of simultaneously running multiple channels. The pump 800 has the capacity to run multiple channels 110*a*-110*i* (e.g., output tubes 710*a*-710*i*) simultaneously. In one embodiment, the pump 800 provides a substantially consistent volumetric flow rate of sample 425 through the channels 110*a*-110*i* which flow in synch. Optionally, the pump 800 self primes and primes the system 10 when, for example, it pulls sample 425 through the system 10 (see, FIG. 1).

Referring also to FIGS. 1 and 2, the system 10 is designed and/or utilized to avoid gas bubbles in the sample 425. Gas bubbles in the sample 425 are an impediment to accurate processing by the processing device 450. Accordingly, components of the system 10 and use of the system 10 is tailored to avoiding gas bubbles in the sample 425. For example, the pump 800 can be, for example, a peristaltic pump that avoids entrainment of gas bubbles in the fluid 150, the sample specimen 420, and/or the sample 425. In addition, the valve 300 pinches a portion of the tubes 210*a*-210*i* to enable and disable fluid 150 flow through the tubes 210*a* 210*i* and, likewise, through a portion of the channels 110*a*-110*i*. Pinching the tubes 210*a*-210*i* via the valve 300, even momentarily, together with pulling the fluid 150, sample specimen 420, and/or the sample 425 via the pump 800 creates a flow spike that can dislodge and eliminate gas bubbles that flow through the system 10. The design and or use of the system 10 can avoid the presence of gas bubbles that reduce the accuracy of the processing device 450.

The systems for processing an analyte and components of the system including the pump, the valve, the socket, the cartridge, and the methods for aligning and actuating and other aspects of what is described herein can be implemented in analyte processing, for example and other suitable systems known to those of ordinary skill in the art. Variations, modifications, and other implementations of what is described herein will occur to those of ordinary skill without departing from the spirit and the scope of the invention. Accordingly, the invention is not to be defined only by the illustrative description.

What is claimed is:

1. A cartridge for processing a sample, comprising:

a body having a first surface and a second surface on opposing faces of the body, the first surface of the body adapted to lay upon a support surface of a housing, the second surface of the body defining one or more cartridge positioning members configured to engage one or more socket positioning members of a socket of the housing;

a sample processing device including a sensor disposed on the second surface of the body of the cartridge, wherein the sample processing device defines a plurality of cavities through which the sample flows, each cavity having a surface defining a membrane sensitive to the flow of the sample;

a plurality of electrical contact pads located in a fixed relation to the one or more cartridge positioning members so that when the socket is spaced proximate to the second surface of the cartridge, the one or more cartridge positioning members engage with the one or more socket positioning members to align the plurality of electrical contact pads of the cartridge with a plurality of electrical contacts of the socket; and the body of the cartridge defining a plurality of fluid conduits, each fluid conduit in fluid communication with a respective cavity of the sample processing device and through which the sample flows to the respective cavity of the sample processing device, each fluid conduit configured to align through the second surface of the body with a magnet of the socket.

2. The cartridge of claim 1 further comprising a plurality of sample inputs, each sample input in fluid communication with a respective fluid conduit.

3. The cartridge of claim 2 wherein each sample input includes a sample reservoir.

4. The cartridge of claim 1 wherein the cartridge defines a raised surface configured to engage the socket and prevent the magnets of the socket from contacting the sample processing device.

5. The cartridge of claim 1 wherein the plurality of cartridge positioning members comprise apertures defined by the surface of the body.

6. The cartridge of claim 1 wherein the plurality of cartridge positioning members comprise pins disposed on the surface of the body.

7. The cartridge of claim 1 wherein the sample processing device is a sensor for sensing the sample in the conduit.

8. The cartridge of claim 1 wherein the sample processing device is a flexural plate wave device.

9. The cartridge of claim 1 wherein the sample processing device is a silicon containing chip.

10. The cartridge of claim 1 further comprising an electrode cover sealing a surface of the sample processing device.

11. The cartridge of claim 1 further comprising a thermal transfer layer disposed on a portion of the first surface of body.

12. The cartridge of claim 1 further comprising a hydrophilic layer disposed on a portion of the first surface of body.

13. The cartridge of claim 1 wherein the sample processing device defines a membrane sensitive to a flow of the sample, wherein the membrane of the sample processing device is configured to form bonds with complexes comprising magnetic particles of the sample.

* * * * *